US009145761B2

(12) United States Patent
Hallundbæk et al.

(10) Patent No.: US 9,145,761 B2
(45) Date of Patent: Sep. 29, 2015

(54) SUBSEA WELL INTERVENTION MODULE

(75) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 287 days.

(21) Appl. No.: 13/634,906

(22) PCT Filed: Mar. 15, 2011

(86) PCT No.: PCT/EP2011/053915

§ 371 (c)(1),
(2), (4) Date: Sep. 14, 2012

(87) PCT Pub. No.: WO2011/113845

PCT Pub. Date: Sep. 22, 2011

(65) Prior Publication Data

US 2013/0008661 A1 Jan. 10, 2013

(30) Foreign Application Priority Data

Mar. 15, 2010 (EP) ..... 10156503

(51) Int. Cl.
*E21B 7/12* (2006.01)
*E21B 41/04* (2006.01)
*E21B 33/076* (2006.01)

(52) U.S. Cl.
CPC ..... *E21B 41/04* (2013.01); *E21B 33/076* (2013.01)

(58) Field of Classification Search
CPC ..... E21B 23/00
USPC ..... 166/338, 341, 349, 351, 77.1; 405/190, 405/191
See application file for complete search history.

(56) References Cited

U.S. PATENT DOCUMENTS 6,454,011 B1 9/2002 Schempf et al.
6,488,093 B2 * 12/2002 Moss ..... 166/339
(Continued)

FOREIGN PATENT DOCUMENTS

RU 2 304 718 5/2003
RU 2 371 580 10/2009
SU 1378787 2/1988

OTHER PUBLICATIONS

International Search Report for PCT/EP2011/053915, mailed Nov. 21, 2011.
(Continued)

*Primary Examiner* — Matthew Buck
*Assistant Examiner* — Aaron Lembo
(74) *Attorney, Agent, or Firm* — Nixon & Vanderhye, P.C.

(57) ABSTRACT

Subsea well intervention module (100) for performing well intervention operations in a well (101) through a well head (120) from a surface vessel (102), comprising a supporting structure (110), a pipe assembly (170) fastened to the supporting structure and having two opposite ends, an inner diameter and a cavity (182) in which an intervention tool (171) may be arranged for pressurizing the cavity (182) when connected to the well head or a blowout preventer arranged on top of the well head to wellbore pressure before at least one valve (121) of a well head is opened and the tool is submerged into the well, a connection member connected with a first end (202) of the pipe assembly for providing a connection to the well head, a wireless intervention tool (171) having an outer diameter and comprising an electrical power device (196). The connection member has an open first end connectable with the well head or blowout preventer and a through-bore providing fluid passage from the first end to the cavity.

25 Claims, 14 Drawing Sheets

(56) References Cited

U.S. PATENT DOCUMENTS

| | | | | |
|---|---|---|---|---|
| 7,036,598 | B2 * | 5/2006 | Skjærseth et al. | 166/339 |
| 7,735,561 | B2 * | 6/2010 | Johnson et al. | 166/339 |
| 7,735,564 | B2 * | 6/2010 | Guerrero | 166/379 |
| 2002/0134552 | A1 | 9/2002 | Moss | |
| 2004/0094305 | A1 | 5/2004 | Skjærseth et al. | |
| 2009/0050329 | A1 | 2/2009 | Johnson et al. | |
| 2009/0159273 | A1 | 6/2009 | Guerrero | |

OTHER PUBLICATIONS

Written Opinion for PCT/EP2011/053915, mailed Nov. 21, 2011.
International Preliminary Report on Patentability for corresponding application PCT/EP2011/053915, issued Sep. 18, 2012, 5 pages.
Russian Office Action issued in Russian Application No. 2012143041/03 (069180), dated Mar. 18, 2015, 5 pages.
Russian Office Action "Decision to Grant" issued in related Russian Patent Application No. 2012143041/03 (069180), dated Jul. 10, 2015 (10 pages).

* cited by examiner

SUBSEA WELL INTERVENTION MODULE

This application is the U.S. national phase of International Application No. PCT/EP2011/053915 filed 15 Mar. 2011 which designated the U.S. and claims priority to EP 10156503.4 filed Mar. 15, 2010, the entire contents of each of which are hereby incorporated by reference.

The present invention relates to a subsea well intervention module for performing well intervention operations in a well from a surface vessel or a rig. The invention also relates to a subsea well intervention system and a subsea well intervention method.

BACKGROUND

During production of oil, it may become necessary to perform maintenance work in a well or to open a production well. Such well work is known as well intervention. A production casing is arranged inside the well, which is closed by a well head in its upper end. The well head may be situated on land, on an oil rig or on the seabed below water.

When a well head is situated on the seabed on deep water, well intervention is more complicated since connection to the well head is obtained under water.

In order to perform such subsea intervention operations, it is a known practice to lower an intervention module from a surface vessel onto the well head structure by means of a plurality of remotely operated vehicles (ROVs).

An intervention tool is placed in a lubricator before being submerged into the well. In order to lower and raise the tool into the well and supply the tool with electricity, the intervention tool is connected to a wireline at its top, which is fed through the lubricator from a winch. A lubricator is a long, high-pressure pipe fitted to the top of a well head, enabling tools to be put into a high-pressure well. The top of the lubricator includes a high-pressure grease injection section and sealing elements for sealing around the wireline. When a tool is placed in the lubricator, the lubricator is pressurised to wellbore pressure before the valves of the well head are opened and the tool is submerged into the well.

In order to seal around the wireline passing through the grease injection section of the lubricator, high-pressure grease is pumped into the surrounding annulus to effect a pressure-tight dynamic seal which is maintained during the operation by injecting more grease as required. A slight leakage of grease is normal, and the addition of fresh grease enables the consistency of the seal to be maintained at an effective level. In this way, grease leaks from the grease injection section into the sea during an intervention operation, which is not environmentally desirable. Due to the increasing awareness of the environment, there is a need for a more environmentally friendly solution.

DESCRIPTION OF THE INVENTION

An aspect of the present invention is, at least partly, to overcome the disadvantages of the above-mentioned known solutions to intervention operations subsea by providing an improved subsea well intervention module which is more environmentally friendly.

This aspect and the advantages becoming evident from the description below are obtained by a subsea well intervention module for performing well intervention operations in a well through a well head from a surface vessel, comprising:

- a supporting structure,
- a pipe assembly fastened to the supporting structure and having two opposite ends, an inner diameter and a cavity in which an intervention tool may be arranged for pressurising the cavity when connected to the well head or a blowout preventer arranged on top of the well head to wellbore pressure before at least one valve of a well head is opened and the tool is submerged into the well,
- a connection member connected with a first end of the pipe assembly for providing a connection to the well head or the blowout preventer, and
- a wireless intervention tool having an outer diameter and comprising an electrical power device.

wherein the connection member has an open first end connectable with the well head or blowout preventer and a through-bore providing fluid passage from the first end to the cavity.

By connection member is meant any kind of connection means for providing a connection to the well head or the blowout preventer.

In one embodiment, the outer diameter of the wireless intervention tool may be at least 50%, preferably at least 75% and more preferably at least 90% of the inner diameter of the pipe assembly.

In another embodiment, the inner diameter of the pipe assembly may be less than an inner diameter of the connection member.

In yet another embodiment, the inner diameter of the pipe assembly may be less than an inner diameter of the well head and/or blowout preventer.

Furthermore, the connection member may have an inner height of at least 10 cm, preferably at least 15 cm, and more preferably at least 20 cm.

In addition, the pipe assembly may have a length of at least 5 meters, preferably at least 8 meters and more preferably at least 10 meters.

Also, the outer diameter of the tool may be less than 4¾ inch or 12 cm.

Moreover, the pipe assembly may have an outer diameter being less than 22 cm, preferably less than 20 cm and more preferably less than 18 cm.

In one embodiment, a second end of the pipe assembly may have a connection device.

In another embodiment, the connection device may be greaseless.

In yet another embodiment, the connection device may form a closure or a lid of the second end.

Furthermore, the connection device may be a solid. The connection device may also be a non-fluid connection or a solid connection.

In addition, the pipe assembly may have a coupling comprising:

- a first end for engaging with the intervention tool in order to recharge and/or communicate data and/or instructions to and from the intervention tool, and
- a second end for connection to an electrical source and/or a communication device.

In one embodiment, the coupling may be arranged at a second end of the pipe assembly.

Also, the coupling may be an inductive coupling having a first coil device facing an inside of the pipe assembly and a second coil device facing an outside of the pipe assembly.

In addition, the coupling may comprise a docking station for engaging with the intervention tool in order to recharge and/or communicate data and/or instructions to and from the intervention tool.

Further, the docking station may comprise a wet connector for engagement with a corresponding connector in the intervention tool.

Additionally, the docking station may be arranged at a second end of the pipe assembly.

The subsea well intervention module according to the invention may further comprise a communication device, and the docking station of the pipe assembly may be connected with the communication device.

In one embodiment, the module may further comprise a container comprising biodegradable fluid.

Said container may have a volume which is less than 30% of the volume of the cavity.

In another embodiment, the coupling may be an inductive coupling having a first coil device facing an inside of the pipe assembly and a second coil device facing an outside of the pipe assembly.

In one embodiment, the first coil device may be arranged in one end of the intervention tool.

In another embodiment, the second coil device may be connected to a wireline.

In yet another embodiment, the coupling may comprise an electrical connection.

Furthermore, the electrical connection may be electrically isolated.

In addition, the second end of the coupling may comprise means for detachably connecting to the intervention tool.

Also, the intervention tool may comprise means for detachably connecting to the coupling.

In one embodiment, the detachable connection between the coupling and the intervention tool may be an electrical connection.

In another embodiment, the module may further comprise a housing having a plurality of batteries, enabling the intervention tool to charge a battery inside the pipe assembly.

In yet another embodiment, the intervention tool may comprise a replacing device for exchanging the battery with another battery in the housing.

Furthermore, the connection device may comprise a union or union nut for connecting the device to the pipe assembly.

In addition, the union or union nut may comprise at least one sealing means, such as an O-ring.

In another embodiment, the electrical power device may be a battery, such as a rechargeable battery.

In yet another embodiment, the module may further comprise a buoyancy system adapted for regulating a buoyancy of the submerged well intervention module, and/or a navigation means, and/or a well manipulation assembly.

By providing the intervention module with a buoyancy system, it is ensured that the module does not hit hard against the seabed or the well head and thereby damages itself or other elements. Furthermore, the intervention module is more easily operated by means of a remotely operated vehicle (also called an ROV).

Furthermore, the subsea well intervention module may have a top part and a bottom part, the bottom part having a higher weight than the top part.

Also, the supporting structure may be a frame structure having an outer form and defining an internal space containing the well manipulation assembly and the navigation means, the well manipulation assembly and the navigation means both extending within the outer form.

In addition, the navigation means may have at least one propulsion unit for manoeuvring the module in the water.

In one embodiment, the supporting structure may be a frame structure having a height, a length and a width corresponding to the dimensions of a standard shipping container.

In another embodiment, the module may further comprise a control system for controlling the well manipulation assembly, the navigation means, the buoyancy system and/or the intervention operations.

In yet another embodiment, the supporting structure may be a frame structure having an outer form and defining an internal space containing a control system, the control system extending within the outer form.

Furthermore, the navigation means may comprise at least one guiding arm for gripping around another structure in order to guide the module into place.

In addition, the navigation means may comprise a detection means for detection of a position of the intervention module.

Also, the buoyancy system may comprise a displacement tank, a control means for controlling the filling of the tank, and an expansion means for expelling sea water from the displacement tank when providing buoyancy to the module to compensate for the weight of the intervention module itself in the water.

In one embodiment, the detection means may comprise at least one image recording means.

In another embodiment, the well manipulation assembly may comprise a tool delivery system comprising at least one tool for submersion into the well, and a tool submersion means for submerging the tool into the well through the well head, at least one well head connection means for connection to the well head, and a well head valve control means for operating at least a first well head valve for providing access of the tool into the well through the well head connection means.

In yet another embodiment, the tool may comprise at least one driving unit for driving the tool forward in the well, powered by the electrical power device.

Furthermore, the well manipulation assembly may comprise a cap removal means for removal of a protective cap on the well head.

In addition, the power device may be a fuel cell, a diesel current generator, an alternator, a producer or the like power supplying means.

Also, the module may further comprise a power system arranged outside the pipe assembly for supplying power to the connection of the module to the well head or another module, such as a cable from the surface vessel, a battery, a fuel cell, a diesel current generator, an alternator, a producer or the like power supplying means.

In another embodiment, the power system may have an amount of reserve power large enough for the control system to disconnect the well head connection means from the well head, the cable for providing power from the power system, the wireline from the intervention module, or the attachment means from the well head structure.

In yet another embodiment, the supporting structure may, at least partly, be made from hollow profiles.

Furthermore, the hollow profiles may enclose a closure comprising a gas.

The present invention also relates to a subsea well intervention system comprising a well head and/or blowout preventer, and at least one subsea intervention module, wherein the connection member of the subsea intervention module may be connected directly to the well head or the blowout preventer.

The subsea well intervention system may further comprise at least one remotely operational vehicle for navigating the intervention module onto the well head or another module subsea.

Further, the well head may comprise a crone plug having an outer diameter and the inner diameter of the pipe assembly may be less than the outer diameter of the crone plug.

Also, the connection member may have an inner height larger than a height of the crone plug.

The invention also relates to a subsea well intervention system comprising at least one subsea intervention module as mentioned above, and at least one remotely operational vehicle for navigating the intervention module onto the well head or another module subsea.

The subsea well intervention system may further comprise at least one remote control means for remotely controlling some or all functionalities of the intervention module, the remote control means being positioned above water.

The communication device may be connected via a wireline to the surface and may communicate via a buoy having a satellite to the remote station.

The subsea well intervention system may also comprise at least one autonomous communication relay device for receiving signals from the intervention module, converting the signals into airborne signals, and transmitting the airborne signals to the remote control means, and vice versa, to receive and convert signals from the remote control means and transmit the converted signals to the intervention module.

Furthermore, the system may comprise the intervention module or parts of the intervention module may be made from metals, such as steel or aluminium, or a lightweight material weighing less than steel, such as polymers or a composite material, e.g. glass or carbon fibre reinforced polymers.

In addition, the invention relates to a subsea well intervention method for performing an intervention operation by means of the intervention module according to any of the preceding claims, comprising the steps of:

positioning a surface vessel or rig in the vicinity of the subsea well head, connecting a subsea well intervention module to the wireline on the vessel, entering the subsea well intervention module into the water, manoeuvring the module onto the well head or blow out preventer, connecting the module to the well head, submitting the tool inside the pipe assembly to the wellbore pressure, opening the valve, and entering the well by means of the intervention tool for performing an operation, recharging the battery in the pipe assembly, and wherein the step of connecting the module to the well head or blowout preventer is connection of the connection member of the module directly to the well head or the blowout preventer.

The method may further comprise the steps of:

changing the battery in the pipe assembly, and/or sending and/or receiving information through the coupling.

The method may further comprise at least one of the following steps:

recharging the battery in the pipe assembly, controlling the navigation means on the intervention module, controlling the control system to perform one or more intervention operations, detaching the module from the well head after performing the operations, recovering the module onto the surface vessel by pulling the wireline, connecting a second subsea well intervention module to the wireline on the vessel, and dumping the second subsea well intervention module into the water from the surface vessel by pushing the module over a side or an end of the vessel before recovering the previous subsea intervention module.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
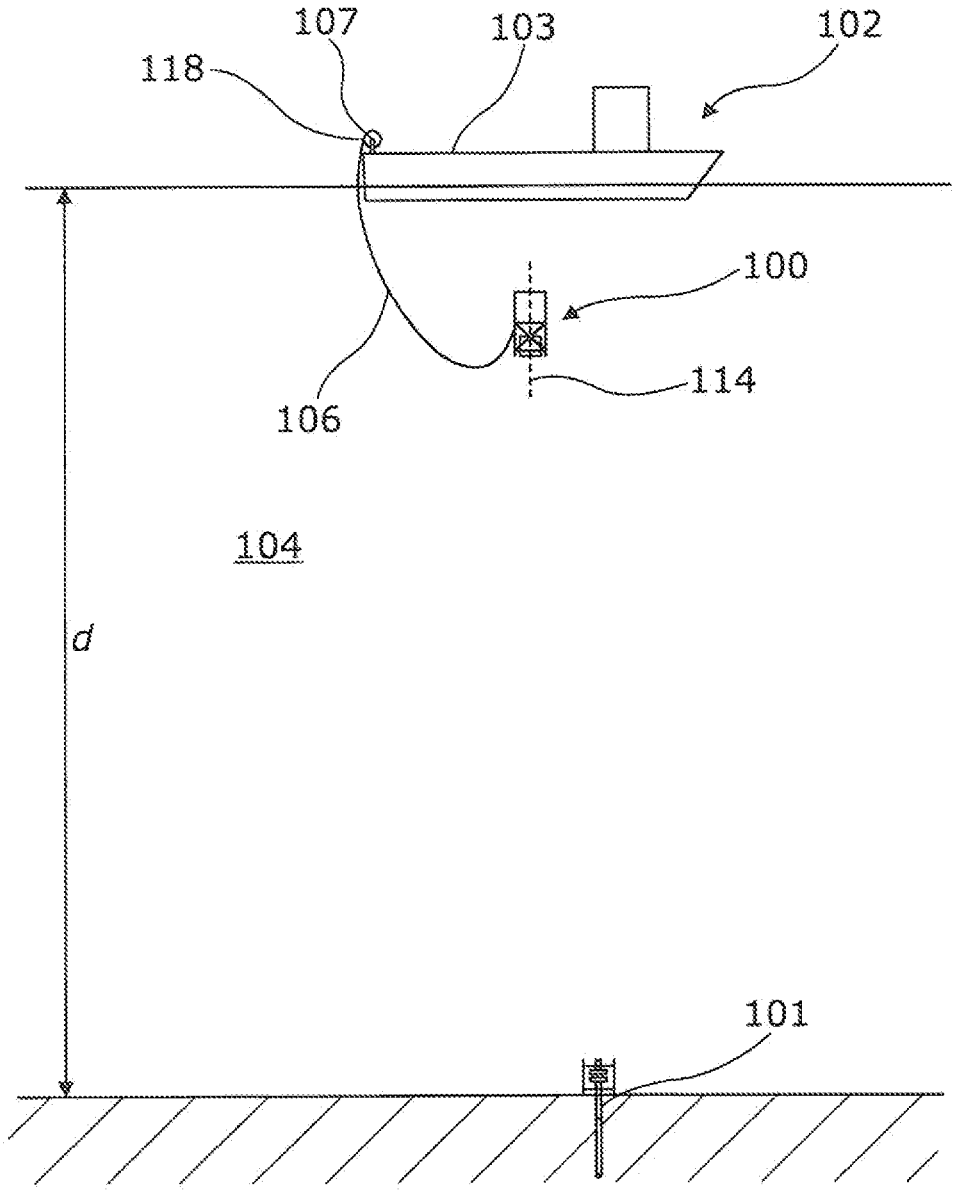
FIG. 1 is a schematic view of an intervention operation.

The present invention relates to a subsea well intervention module 100 for performing intervention operations on subsea oil wells 101, as shown in FIG. 1. The subsea intervention module 100 is launched from a surface vessel 102, e.g. by simply pushing the module 100 into the sea from a deck in the back of the vessel 102 or over a side 103 of the vessel 102. Since the intervention module can be launched just by dumping the module 100 into the water, launching is feasible by a greater variety of vessels, including vessels which are more commonly available. Thus, the intervention module 100 may also be launched into the water 104 by means of e.g. a crane (not shown). Furthermore, the intervention module may be launched into the water 104 directly from a rig or by a helicopter.

Figure 2:
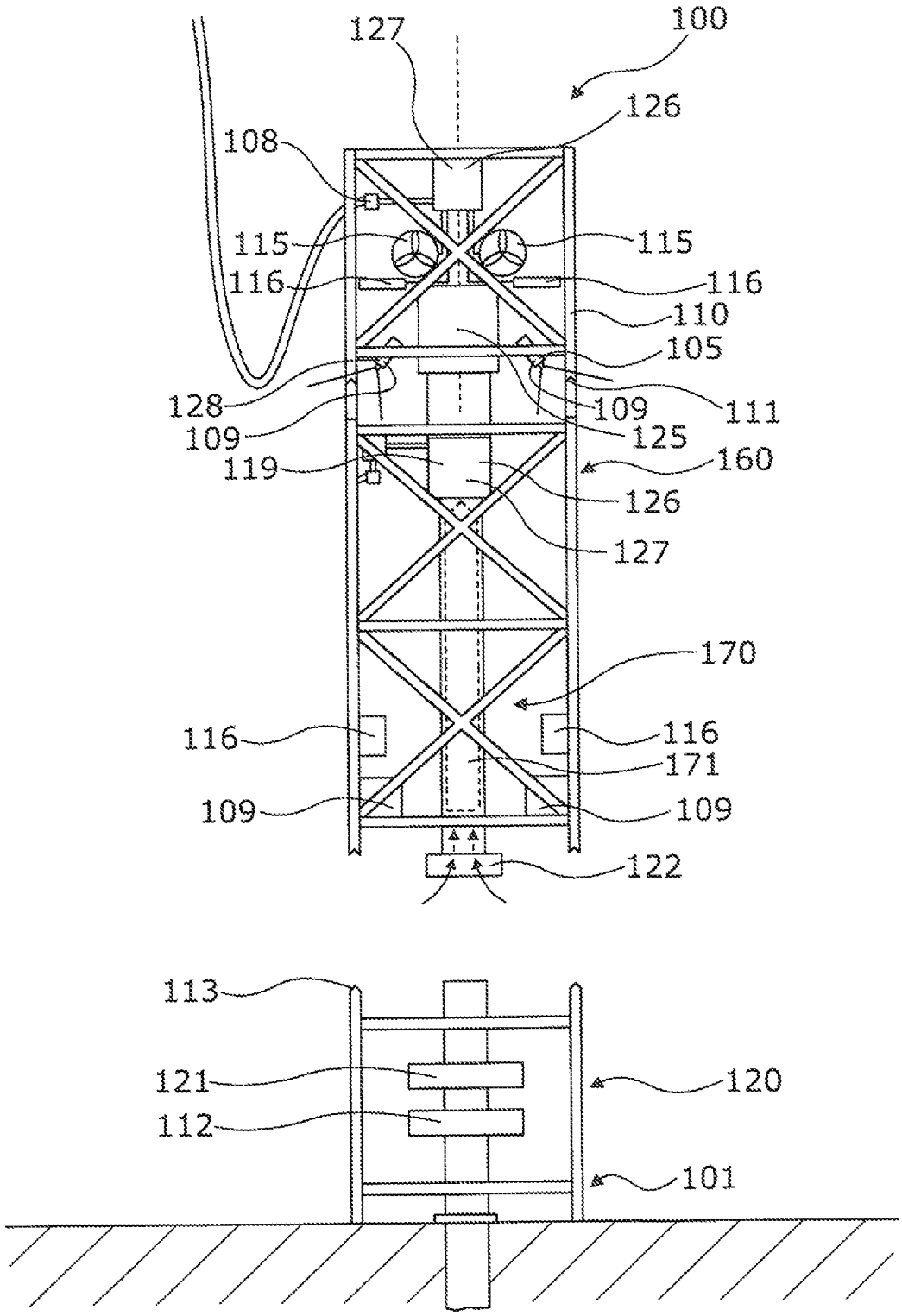
FIG. 2 is a schematic view of an intervention module according to the invention being docked on a well head.

When the intervention module 100 has been launched, it navigates to the well 101 by means of a navigation means 105 or a Remote Operational Vehicle (also called an ROV) to perform the intervention, as shown in FIG. 2.

In another embodiment, the navigation means 105 comprises communicational means allowing an operator, e.g. located on the surface vessel 102, to remotely control the intervention module 100 via a control system 126. The intervention module may be launched by using a wire, and when the module is docked onto the well head or blowout preventer, the wire is disconnected so that the vessel is free to float which is especially useful in stormy weather. The remote control signals for the navigation means 105 and the power to the intervention module 100 may be provided through a cable 106, such as an umbilical or a tether, which is spooled out from a cable winch 107. This cable may also subsequently be disconnected so that communication is performed wirelessly or through an ROV or the like means.

Figure 6A:
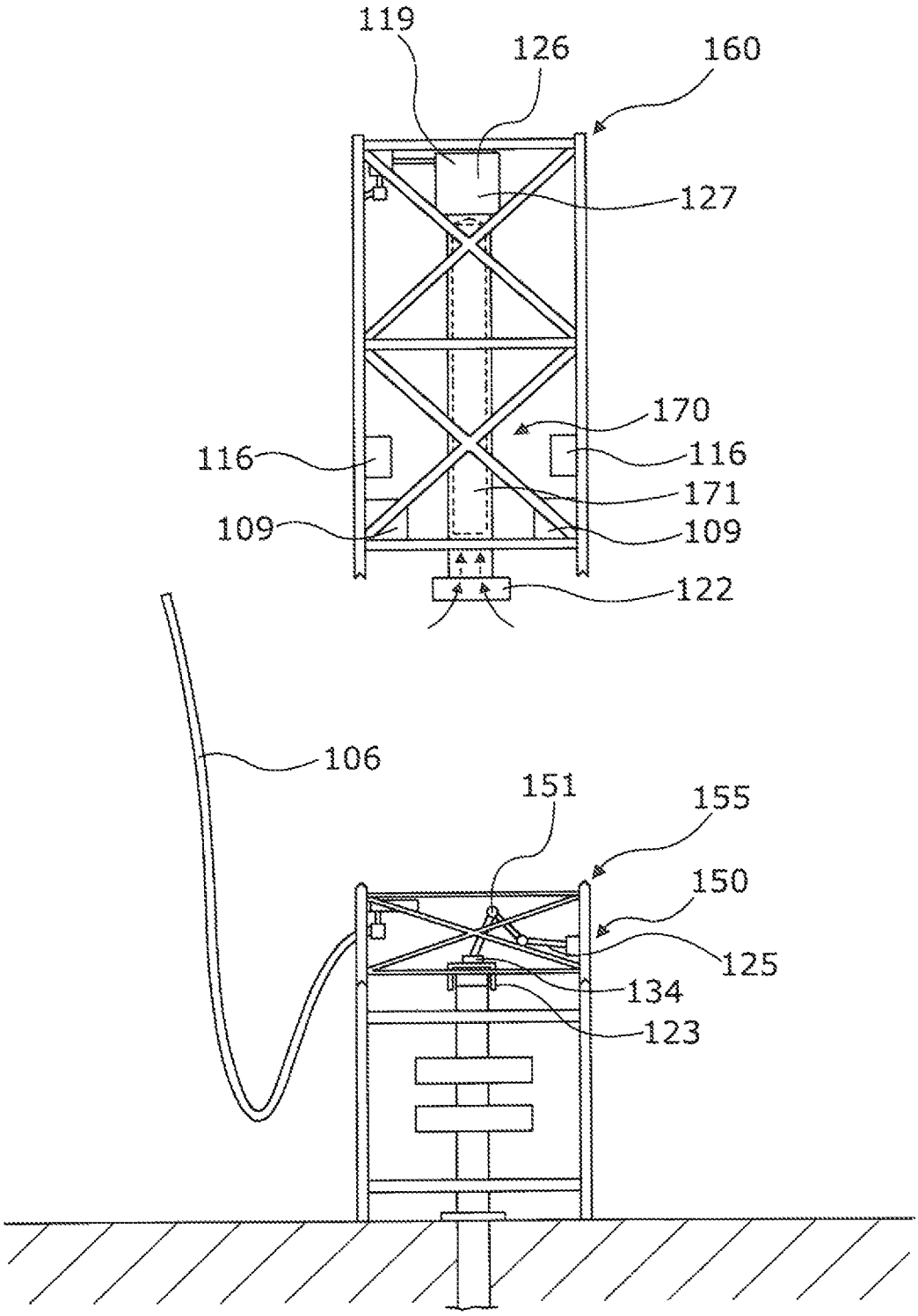
FIG. 6A is a schematic view of one embodiment of an intervention module in which a cap of the well head is being removed.
Figure 7:
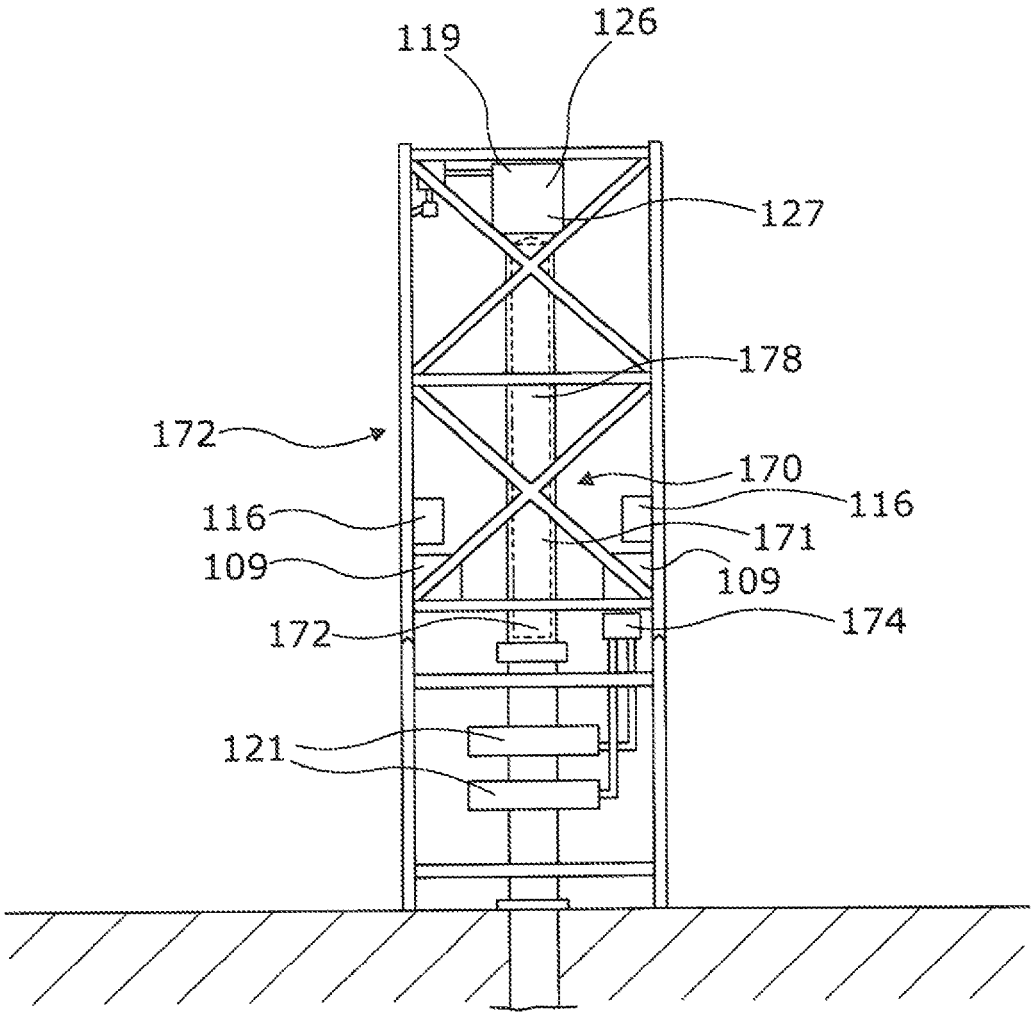
FIG. 7 is a schematic view of another embodiment of an intervention module.

A well head 120 located on the sea floor, as shown in FIGS. 2 and 7, is the upper termination of the well 101 and comprises two well head valves 121 as well as terminals for connection of a production pipe line (not shown) and for various permanent and temporary connections. The valves 121 may typically be operated mechanically, hydraulically or both. At its top, the well head 120 has a protective cap 123 which must be removed before proceeding with other intervention tasks as shown in FIG. 6A. Typically, subsea well heads 120 are surrounded by carrying structures 112 to provide load relief for the well head 120 itself when external units are connected. The carrying structure 112 may be equipped with two, three or four attachment posts 113. The attachment means 111 of the intervention module 100 must be adapted to the specific type of carrying structure 112 on the well head 120 which the intervention module is to be docked onto. The attachment means 111 may simply support the intervention module on the carrying structure 112 by gravity, or it may comprise one or more locking devices to keep the module 100 in place on the well head 120 after docking has taken place.

Docking of the intervention module 100 is performed by remote control. The intervention module 100 is navigated to the well head 120, rotated to be aligned with the well head structure, and steered to dock on the structure, as shown in FIG. 2. This may be done by an ROV (not shown) or a navigation means 105 having propulsion means and being provided in the subsea intervention module 100.

The subsea well intervention module 100, 160 according to the invention is formed by the supporting structure 110 and a pipe assembly 170 fastened to the structure. The pipe assembly 170, 178 has an elongated body with two opposite ends and a cavity 182 in which an intervention tool 171 may be arranged for pressurising the cavity to wellbore pressure before at least one valve 121 of a well head 120 is opened and the tool 171 is submerged into the well. The first end 202 of the pipe assembly 170, 178 is connected to the well head 120 via a connection member. The module 100 also comprises a wireless intervention tool which is wirelessly connected and arranged in the pipe assembly 170, 178 when the module 100 is submerged into the water. The intervention tool 171 comprises an electrical power device 196, such as a battery pack, and is thus not powered through a wireline directly connected to one end of the tool. Thus, the pipe assembly 170, also called a lubricator, does not have a grease connection head or a grease injection system due to the fact that a wireline no longer has to be able to move through the lubricator.

Figure 6B:
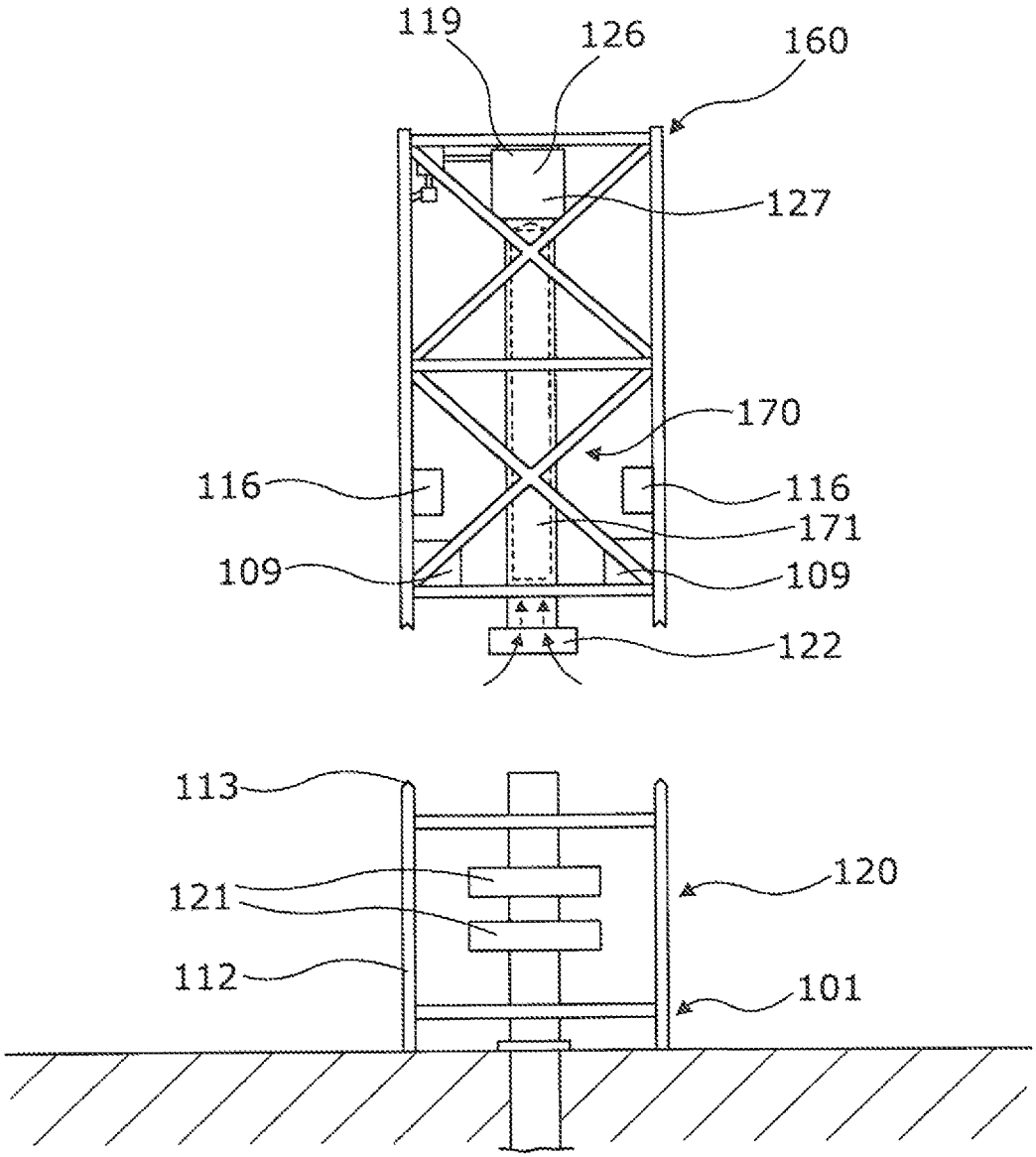
FIG. 6B is a schematic view of another embodiment of the intervention module for mounting directly onto a well head.
Figure 6C:
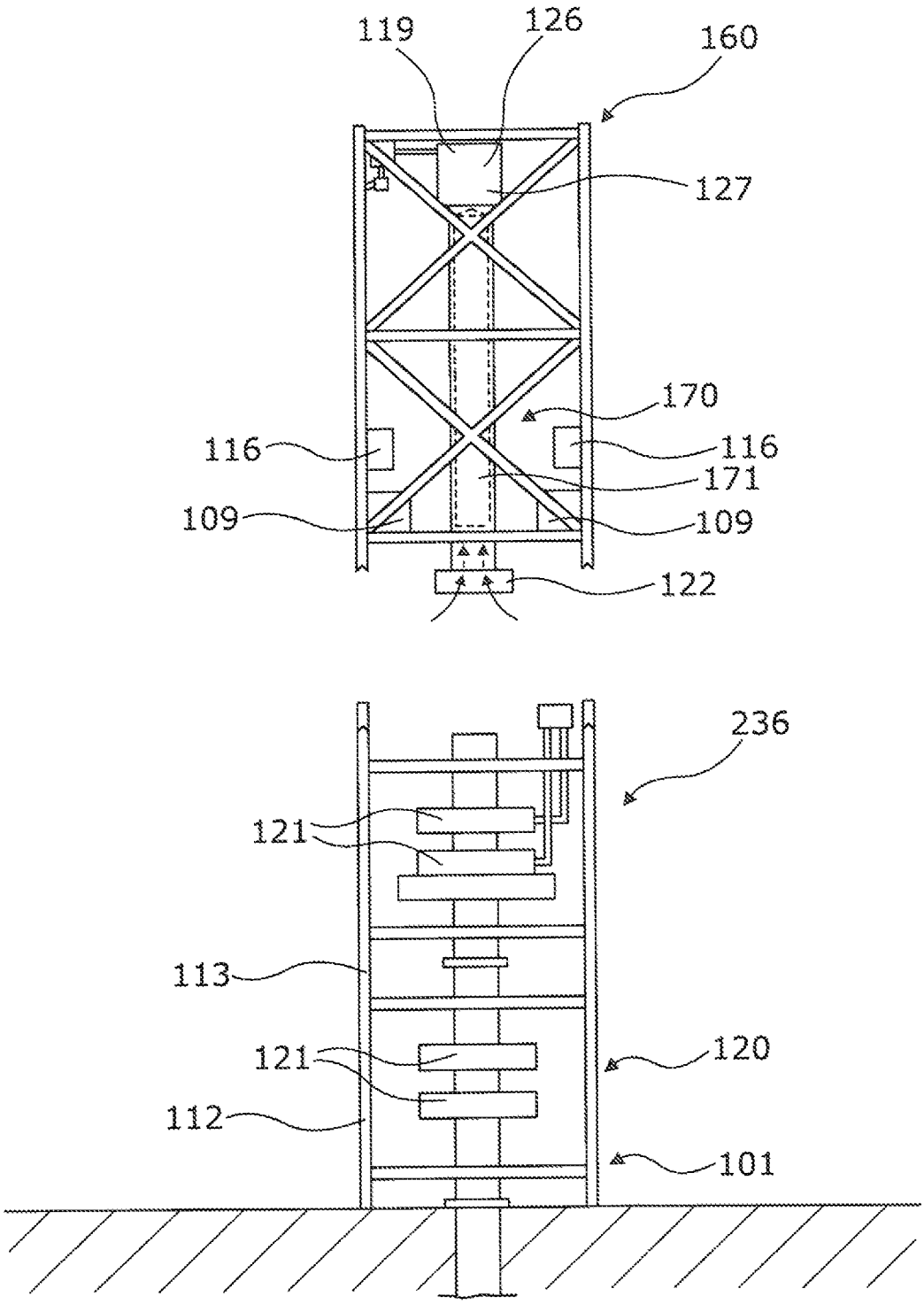
FIG. 6C is a schematic view of another embodiment of the intervention module for mounting directly onto a blowout preventer arranged on the well head.

The subsea well intervention module performs well intervention operations in a well 101 through a well head directly as shown in FIGS. 6A and 6B or through a blowout preventer 236 arranged on the well head 120 as shown in FIG. 6C. The pipe assembly 170, 178 is connected to the well head or blowout preventer through a connection member 122 which is connected with a first end 202 of the pipe assembly for providing the connection to the well head 120 or blowout preventer 236. The pipe assembly 170, 178 has the cavity 182 in which an intervention tool 171 is arranged. When connected to the well head 120 or a blowout preventer 236, the cavity arranged is pressurised to wellbore pressure before at least one valve 121 of a well head 120 is opened and the tool is submerged into the well. As shown in FIGS. 6A, 11-13, the connection member 122 has an open first end 237 connectable with the well head 120 or blowout preventer 236 and a through-bore 240 providing fluid passage from the first end to the cavity. Fluid flowing into the pipe assembly through the connection member is indicated by arrows.

The connection member is connected directly onto the well head 120 or the blowout preventer 236 without any intermediate connection and the cavity is filled with sea water while descending. This results in a very simple construction and when connected to the well head 120 or blowout preventer 236, the cavity is easily pressurised to well pressure. When the intervention tool returns in the pipe assembly, the pressure is decreased and the well fluid inside the pipe assembly is exchanged with a more biodegradable and non-polluting fluid before the pipe assembly is disconnected.

Figure 11:
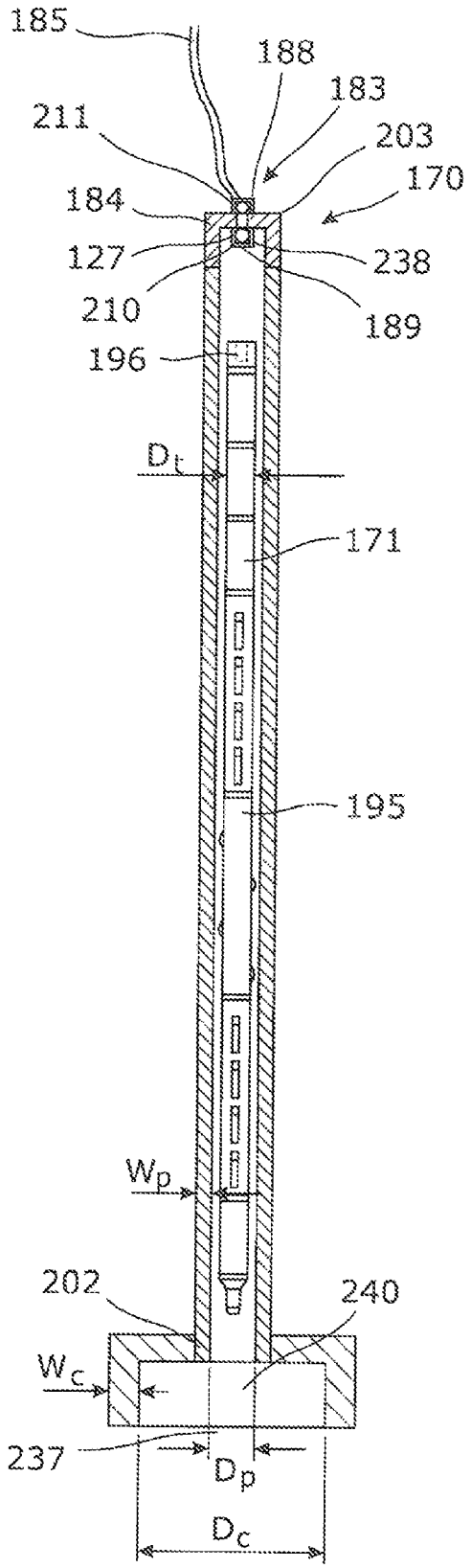
FIG. 11 shows a cross-sectional view of one embodiment of the pipe assembly according to the invention having an open end connection member.
Figure 12:
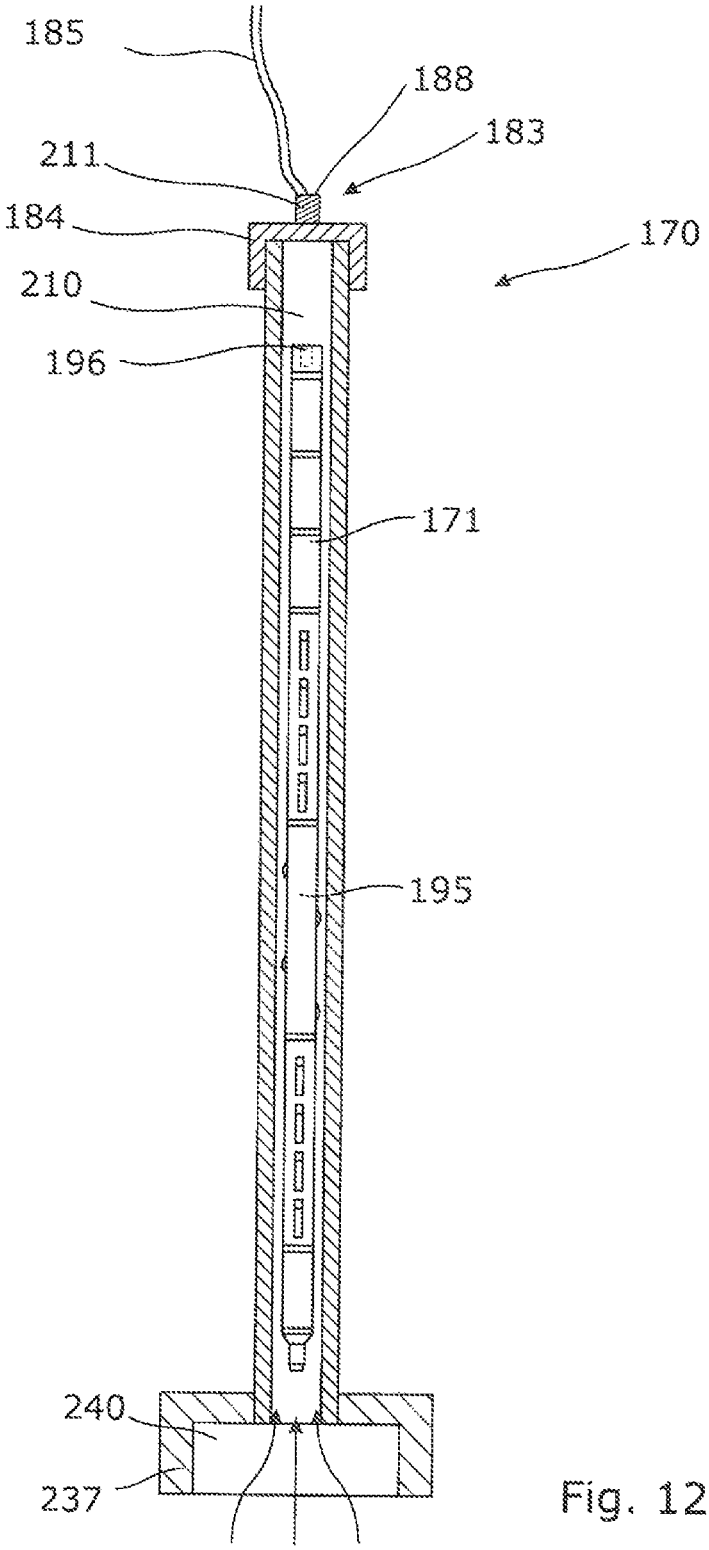
FIG. 12 shows a cross-sectional view of another embodiment of the pipe assembly with an open end connection member.
Figure 13:
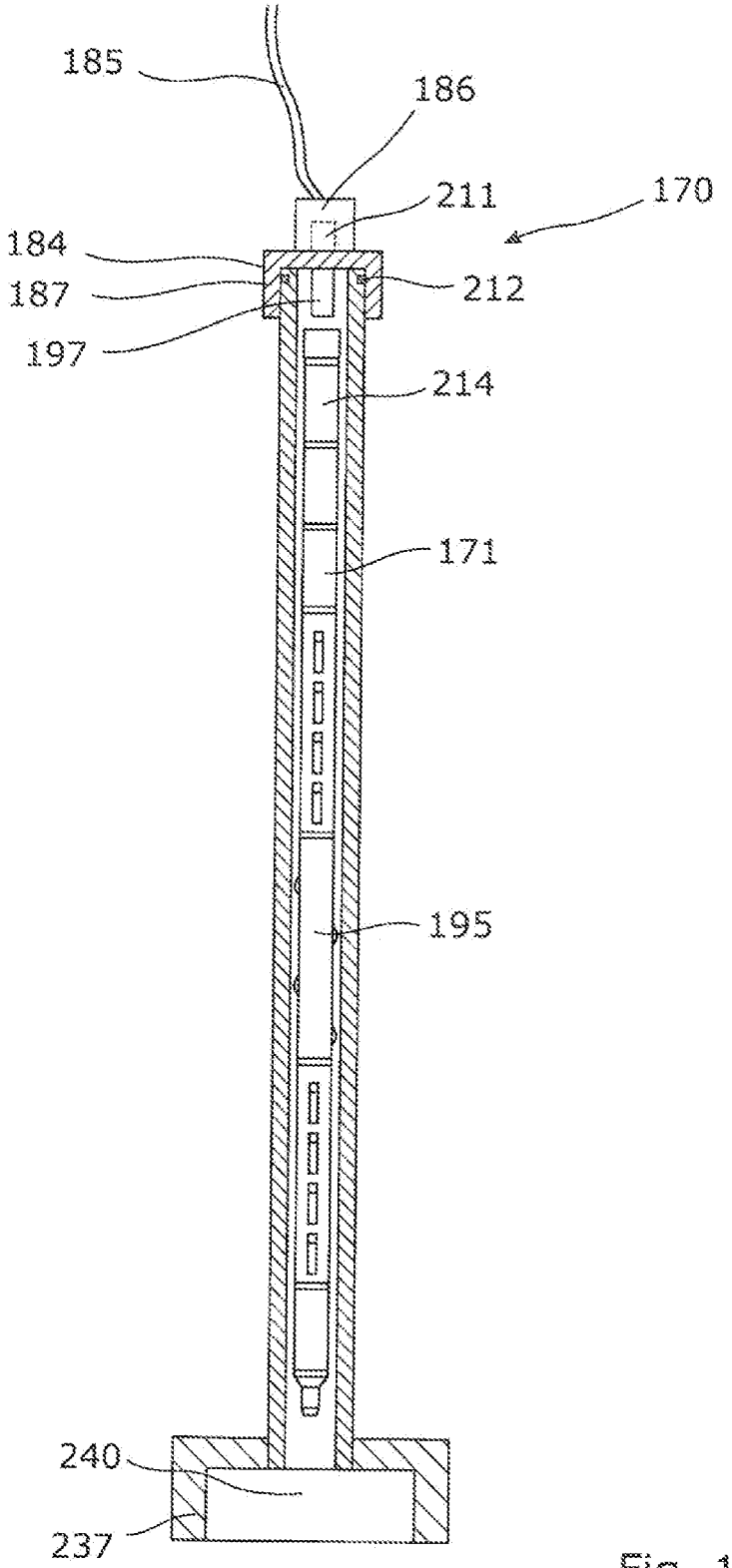
FIG. 13 shows a cross-sectional view of yet another embodiment of the pipe assembly with an open end connection member.

As shown in FIGS. 11-13, the pipe assembly 170, 178 has an inner diameter $D_p$ and the wireless intervention tool 171 has an outer diameter $D_t$ which is at least 50%, preferably at least 75% and more preferably at least 90% of the inner diameter of the pipe assembly. By having a intervention tool having an outer diameter which is at least 75% of the inner diameter of the pipe assembly, the amount of fluid to be displaced while pressurising or changed before disconnecting the pipe assembly is substantially less than in the known prior art lubricators. In order to displace the polluting well fluid, the module comprises a container 239 of biodegradable, such as glycol, or other non-polluting fluid. By having a pipe assembly having a substantially smaller inner diameter than the known lubricators, the container can also be substantially smaller than the known containers. Having a smaller container reduces the overall size of the module and the weight of the module. The container has a volume of less than 30% of the volume of the cavity.

In order to pull a crone plug arranged as a seal in the well head, the diameter of prior art lubricators is somewhat larger than the diameter of the crone plug. The tool in the lubricator pulls the first crone plug and the lubricator is disconnected and a second tool for pulling the second crone plug is connected to the well head. As shown in FIGS. 11-13, the inner diameter of the pipe assembly is less than an inner diameter $D_c$ of the connection member. The inner diameter of the connection member corresponds to the outer diameter of the crone plug and the crone plug is maintained in the connection member and not in the lubricator. Thus, the lubricator or pipe assembly can be made smaller by having a smaller inner diameter than the outer diameter of the crone plug. The inner diameter of the pipe assembly may thus be less than an inner diameter of the well head and/or blowout preventer.

In FIGS. 11-13, the connection member has a size so that when connected to the well head or blowout preventer, the crone plug pulled by the intervention tool is enclosed by the connection member. In order to make the connection member of such a larger diameter, the wall thickness ($w_c$) of the connection member is higher than the wall thickness ($w_p$) of the pipe assembly. The wall thickness of the pipe assembly can thus be decreased in relation to prior art lubricators as the crone plug is kept in the connection member and not in the pipe assembly.

Furthermore, the connection member 122 has an inner height larger than the height of the crone plug. Thus, the connection member has an inner height of at least 10 cm, preferably at least 15 cm, and more preferably at least 20 cm.

The subsea intervention module 100 is prepared above sea by opening the pipe assembly 170 and inserting the intervention tool 171 by means of a specific operation tool, such as a connector for pulling a first and second crone plug arranged in the well head 120 or blowout preventer 236. Subsequently, the specific operational tool is mounted onto a driving unit 195, such as a downhole tractor, and the intervention tool 171. Subsequently, the pipe assembly 170 is closed again, and the module is ready to be submerged into the sea.

The pipe assembly 170 has a connecting device 184 enabling it to open and close. The connection device 184 is grease-less, meaning that it does not have a unit for fluidly tightening it around a wireline.

As shown in FIG. 11, the pipe assembly has a coupling 183 for transferring electricity to the intervention tool so as to recharge it or to communicate data to and/or from the intervention tool. The coupling 183 comprises a first end 188 for providing a connection to an electrical source 185 and/or a communication device 186 and a second end 189 for engaging with the intervention tool in order to recharge and/or communicate with the intervention tool. The second end may comprise a wet connector 238.

The coupling 183 is an inductive coupling having a first coil device 210 facing an inside of the pipe assembly 170 and a second coil device 211 facing an outside of the pipe assembly. As can be seen, the second coil device 211 is connected to and powered by a wireline 185. The wireline 106 may also be connected at another position on the intervention module, where the wireline extends within the frame structure to the pipe assembly. The wireline may also comprise a disconnectable communication cable other than the electricity cables. The coils surround one core penetrating the connection device 184. In this way, current is transferred from the outside of the pipe assembly 170 to the inside of the assembly without needing a wireline to pass the top of the lid and thus without needing a grease injection system.

The intervention tool 171 has an internal electrical power device 196 situated in one end of the intervention tool facing the coupling 183, enabling the power device to be recharged by engaging the first end 189 of the coupling. The tool 171 has means for detachably engaging the coupling 183, such as a wet connector, in order to be recharged, and in the same way, the second end of the coupling has means for detachably connecting to the tool, such as a connector matching the wet connector.

As mentioned above, the coupling 183 may be an inductive coupling transferring current through the pipe assembly 170. In FIG. 12, the first coil device 210 is arranged in one end of the intervention tool 171, and when the tool needs recharging, the first coil device abuts the inside wall of the second end 203 of the pipe assembly 170 in order to transfer the current and thereby charge the power device in the tool 171. In this way, the tool can detachably connect to the coupling 183. The second coil device 211 is connected directly to an electrical supply line in order to provide the tool 171 with electricity. This also takes place during the operation or between two operations.

In FIG. 11, the connection device 184 closes the pipe assembly 170 by means of a screw connection, and in FIG. 12, the connection device 184 forms a closure or a lid. The connection device 184 may also be formed as part of the pipe assembly and thus unattachably connected thereto. The closure or lid is fastened to the pipe assembly 170 on the outside of the pipe assembly by means of a screw connection or a snap lock in which snap lock a projection of the pipe assembly engages a grove in the lid. In order to ease the closing of the pipe assembly 170, the connection device 184 may comprise a union or union nut for connecting the device to the pipe assembly without having to twist the wireline.

The connection device 184 is a solid connection which does not use grease, but instead uses a sealing means 212, such as an O-ring. The connection device 184 may also comprise an electrical connection which is electrically isolated in order to avoid short-circuiting the system, such as a wet connector 238.

The detachable connection between the coupling 183 and the intervention tool 171 may be an electrical connection, and the detachable connection of the tool and the coupling is thus an electrical plug solution.

In FIG. 6B, the coupling comprises a docking station 127 for engaging with the intervention tool in order to recharge and/or communicate data and/or instructions to and from the intervention tool. The docking station 127 may comprise a wet connector 238 for engagement with a corresponding connector in the intervention tool. The docking station 127 is arranged at a second end of the pipe assembly furthest away from the well head 120.

The subsea intervention module 100 may comprise a communication device 186 and the docking station 127 of the pipe assembly 170, 178 is connected with the communication device in order to transfer data to and from the intervention tool. The data is then received or transmitted by the communication device to and from a remote control centre.

The electrical power in the tool device may be a battery, such as a rechargeable battery. In FIG. 13, the pipe assembly 170 comprises a housing 197 having a plurality of batteries, enabling the intervention tool 171 to charge a battery inside the pipe assembly without having to open the pipe assembly and take out the intervention tool. For this purpose, the intervention tool 171 comprises a replacing device for exchanging the battery with another battery in the housing.

The wireline may also merely or partly be used for transferring data from the tool 171 to the surface, or the coupling 183 may have a memory or a communication device 186 on its outside, as shown in FIG. 13. The memory or the communication device 186 may also be emptied at predetermined intervals by an ROV or another module.

Figure 4:
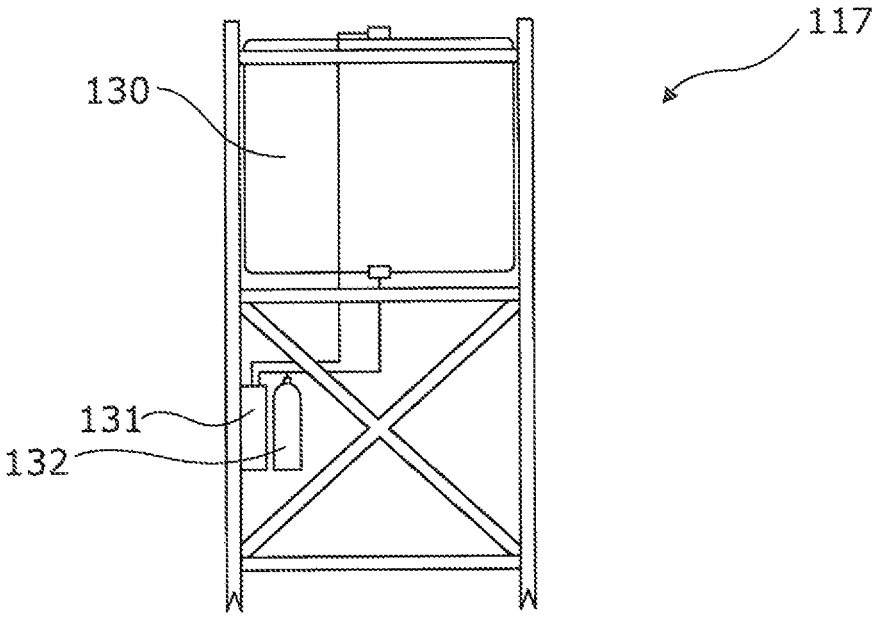
FIGS. 4 and 5 are schematic views of two embodiments of buoyancy systems for mounting onto the module according to the invention.
Figure 5:
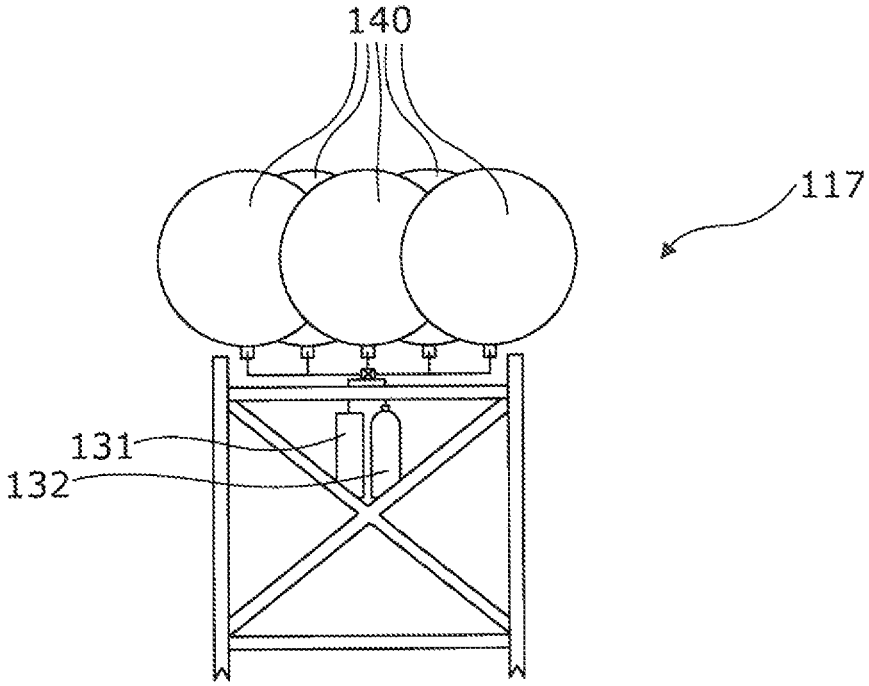

In order to obtain good vertical manoeuvrability, the navigation means 105 is provided with a buoyancy system 117 adapted for regulating a buoyancy of the submerged well intervention module 100. Buoyancy systems are shown in FIGS. 4 and 5. By controlling the buoyancy of the intervention module 100 while submerged, the module may be made to sink (negative buoyancy), maintain a given depth (neutral buoyancy) or rise (positive buoyancy) in the water 104. By using this principle to provide better vertical manoeuvrability, even heavy objects may be controlled efficiently as exemplified by submarines utilising such arrangements. In one embodiment, minor vertical position adjustments may be performed with a vertical propulsion unit 116 suitably oriented.

Providing the well intervention module 100 with substantially increased buoyancy has the additional effect that it lowers the resulting force exerted on the well head 120 by the weight of the module 100. Preferably, the intervention module 100 should be maintained at near neutral buoyancy, i.e. be "weightless". This lowers the risk of rupture of the well head 120, which would otherwise result in a massive environmental disaster.

To aid this docking procedure, the navigation means 105 comprises a detection means 109, as shown in FIG. 2, for detection of the position of the intervention module 100 in the water 104.

Having an intervention module 100 capable of manoeuvring independently in the water 104 reduces the requirements for the surface vessel 102 since the vessel 102 merely needs to launch the intervention module in the water 104, after which the module 100 is able to descend into the water under its own command, thus alleviating the need for expensive specially equipped surface vessels, e.g. with large heave-compensated crane systems (not shown).

Furthermore, the lower part of the subsea intervention module 100 weighs more than the upper part of the subsea intervention module. This is done to ensure that the module does not turn upside down when being submerged so that the bottom and not the top of the module 100 is facing the well head structure or another module onto which it is to be mounted.

The intervention module 100 may be remotely controlled by a combined power/control cable 106, 185, by separate cables or even wirelessly. Since the intervention module 100 comprises navigation means 105 enabling the module to move freely in the water 104, no guiding wires or other external guiding mechanisms are needed to dock the module onto the well head 120. In some events, the wireline connection 108, 118 between the surface vessel 102 and the module 100 needs to be disconnected, and in these events, the module of the present invention is still able to proceed with the current operation. Furthermore, there is no need for launching additional vehicles, such as ROVs, to control the intervention module 100. This leads to a simpler operation where the surface vessel 102 has a larger degree of flexibility, e.g. to move away from approaching objects, etc. However, ROVs may be used for the docking of the module onto the well head 120 or the blowout preventer 236.

The navigation means 105 may have a propulsion unit 115, 116, a detection means 109 and/or a buoyancy system 117. If the navigation means 105 of the module 100 has both a propulsion unit 115, 116 and a detection means 109, the propulsion unit is able to move the module into place onto another module or a well head structure on the seabed. If the module 100 only has a buoyancy system 117, a remotely operational vehicle is still needed to move the module into position, however, the buoyancy system makes the navigation much easier.

Furthermore, when the bottom part of the module 100 weighs more than the top part, it is ensured that the module always has the right orientation.

The subsea well intervention module 100, 160 according to the invention is formed by the supporting structure 110 onto which the various subsystems of the intervention module may be mounted. Subsystems may be a propulsion unit as shown in FIG. 2 or a buoyancy system 117. The supporting structure 110 comprises attachment means 111 for removably attaching the supporting structure 110 to a structure 112 of a well head 120 or an additional structure of the well head. Thus, the attachment means 111 allows the intervention module 100 to be docked on top of the well head 120 or the blowout preventer 236. A first module is used for removing the cap of the well head 120, and the second module is used in the intervention operation for launching a tool into the well 101.

When one intervention module is docked onto the well head 120 or blowout preventer 236 e.g. for pulling a crone plug, another intervention module is mounted with another tool for performing a second operation in the well, also called a second run. When the module for the second run is ready to use, the module is dumped into the water 104 and waits in the vicinity of the well head 120 ready to be mounted when the "first run" is finished. In this way, mounting of the tool for the next run can be done while the previous run is performed.

As a result, each module can be mounted with one specific tool decreasing the weight of the module on the well head 120 since a module does not have a big tool delivery system with a lot of tools and means for handling the tools, but just one simple pipe assembly 170. In this way, an intermediate launch conduit for changing tool is avoided, leaving the risk of contaminating the sea water as such conduit will be difficult to empty and displace with other biodegradable fluid. In addition, containers of such module having an intermediate launch conduit would be very large, decreasing the weight of the module. Furthermore, there is no risk of a tool getting stuck in the tool delivery system. In addition, they may be more particularly designed for a certain purpose since other helping means can be built in relation to the tool, which is not possible in a tool delivery system.

As shown in FIG. 2, the intervention module 100 comprises a well manipulation assembly 125 enabling the intervention module to perform various well intervention operations needed to complete an intervention job. Furthermore, the intervention module 100 has a navigation means 105 with a propulsion unit 115, 116 for manoeuvring the module sideways in the water 104. However, the propulsion unit 115, 116 may also be designed to move the module 100 up and down. Additionally, the intervention module 100 has a control system 126 for controlling the well manipulation assembly 125, the navigation means 105 and the intervention operations, such as a tool 171 operating in the well 101.

The supporting structure 110 is made to allow water to pass through the structure, thus minimising the cross-sectional area on which any water flow may act, as shown in FIGS. 2-7. Thus, the module 100 can navigate faster through the water by reducing the drag of the module. Furthermore, an open structure enables easy access to the components of the intervention module 100.

In another embodiment, the supporting structure 110 is constructed, at least partly, as a tube frame structure since such a construction minimises the weight. Thus, the supporting structure 110 may be designed from hollow profiles, such as tubes, to make the structure more lightweight. Such a lightweight intervention module results in reduced weight on the well head 120 when the module is docked onto the same, reducing the risk of damage to the well head. Furthermore, a lightweight intervention module enables easier handling of the module 100, e.g. while aboard the surface vessel 102.

The supporting structure 110 could be made from metal, such as steel or aluminium, or a lightweight material weighing less than steel, such as a composite material, e.g. glass or carbon fibre reinforced polymers. Some parts of the supporting structure 110 could also be made from polymeric materials.

Other parts of the intervention module 100 could also be made from metals, such as steel or aluminium, or a lightweight material weighing less than steel, such as polymers or a composite material, e.g. glass or carbon fibre reinforced polymers. Such other parts of the intervention module 100 could be at least part of the attachment means 111, the well manipulation assembly 125, the navigation means 105, the propulsion unit 115, 116, the control system 126, the detection means 109, the winch un-coiling a local wireline, the tool exchanging assembly, the tool delivery system, the power storage system 119 or the like means of the intervention module 100.

The supporting structure 110 may also be made of hollow profiles enclosing gas, providing further buoyancy to the module 100 when submerged into the sea.

Figure 3:
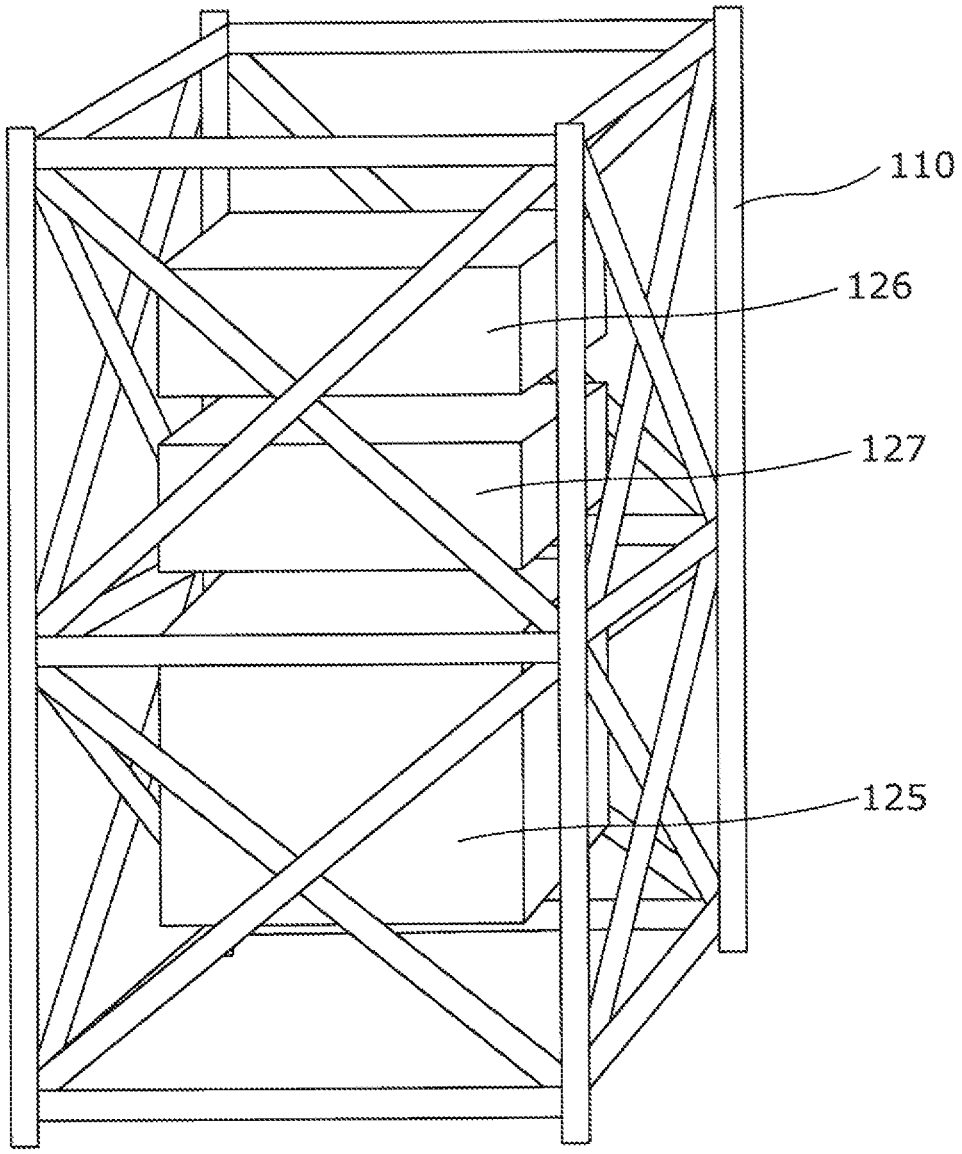
FIG. 3 is a schematic view of an intervention module according to the invention.

FIG. 3 shows how the supporting structure 110 of an embodiment of the intervention module fully contains the navigation means 105, the control system 126 and the well manipulation assembly 125 within the outer form of the frame. Thus, the supporting structure 110 protects the navigation means 105, the control system 126 and the well manipulation assembly 125 from impact with e.g. the sea floor or objects on the surface vessel 102. Therefore, the intervention module 100 is able to withstand being bumped against the sea floor when it descends, and to lay directly on the sea floor, e.g. when waiting to be docked on the well head 120.

In order to perform a well intervention, a cap of the well head 120 has to be removed, and subsequently, a tool is launched into the well 101 as shown in FIG. 7. Therefore, the first module 150 to dock onto the well head 120 is a module where the well manipulation assembly 125 comprises means for removing a protective cap 123, as shown in FIG. 6A. In a next intervention step as shown in FIG. 6B, a second intervention 160 module comprising means for deploying a tool 171 into the well 101 is docked onto the first module 150 as shown in FIG. 7. In FIG. 6C, a blowout preventer 236 is arranged on top of the well head 120.

The detection means 109 uses ultrasound, acoustic means, electromagnetic means, optics or a combination thereof for detecting the position of the module 100 and for navigating the module onto the well head 120 or another module. When using a combination of navigation techniques, the detection means 109 can detect the depth, the position and the orientation of the module 100. Ultrasound may be used to gauge the water depth beneath the intervention module 100 and to determine the vertical position, and at the same time, a gyroscope may be used to determine the orientation of the intervention module. One or more accelerometers may be used to determine movement in a horizontal plane with respect to a known initial position. Such a system may provide full position information about the intervention module 100.

In another embodiment, the detection means 109 comprises at least one image recording means, such as a video camera. Furthermore, the image recording means comprises means for relaying the image signals to the surface vessel 102 via the control system 126. The video camera is preferably oriented to show the attachment means 111 of the intervention module 100 as well as the well head 120 during the docking procedure. This enables an operator to guide the intervention module 100 by vision, e.g. while the module is being docked on the well head 120. As shown in FIG. 2, the image recording means may be mounted on the supporting structure 110 of the intervention module 100 in a fixed position, or be mounted on a directional mount which may be remotely controlled by an operator. Evident to the person skilled in the art, the vision system may comprise any number of suitable light sources to illuminate objects within the optical path of the vision system.

In another embodiment, the image recording means further comprises means for analysing the recorded image signal, e.g. to enable an autonomous navigational system to manoeuvre the intervention module 100 by vision.

To achieve better manoeuvrability of the intervention module 100 while submerged, it must be able to maintain its vertical position within the water 104, simultaneously be able to move in the horizontal plane, and be able to rotate around a vertical axis 114, allowing the attachment means 111 to be aligned with the attachment posts 113 of the carrying structure 112 of the well head 120 for docking.

Horizontal manoeuvrability as well as rotation may be provided by one or more propulsion units 115, 116, such as thrusters, water jets or any other suitable means of underwater propulsion. In one embodiment, the propulsion units 115, 116 are mounted onto the intervention module 100 in a fixed position, i.e. each propulsion unit 115, 116 has a fixed thrust direction in relation to the intervention module 100. In this embodiment, at least three propulsion units 115, 116 are used to provide movability of the module 100. In another embodiment, the thrust direction from one or more of the propulsion units 115, 116 may be controlled, either by rotating the propulsion unit itself or by directing the water flow, e.g. by use of a rudder arrangement or the like. Such a setup makes it possible to achieve full manoeuvrability with a smaller number of propulsion units 115, 116 than necessary if the units are fixed to the intervention module 100.

The intervention module 100 may be remotely operated, be operated by an autonomous system or a combination of the two. For example, in one embodiment, docking of the module is performed by a remote operator, but an autonomous system maintains e.g. neutral buoyancy while the module 100 is attached to the well head 120. The buoyancy system 117 may furthermore provide means for adjusting the buoyancy to account for changes in density of the surrounding sea water, arising from e.g. changes in temperature or salinity.

FIGS. 4 and 5 show two different embodiments of buoyancy systems 117. Generally, the buoyancy system 117 must be able to displace a mass of water corresponding to the total weight of the intervention module 100 itself. For example, if the module weighs 30 tonnes, the mass of the water displaced must be 30 tonnes, roughly corresponding to a volume of 30 cubic meters, to establish neutral buoyancy. However, not the full volume will need to be filled with water for the module 100 to descend since this would make the module sink very quickly. Therefore, a part of the buoyancy system 117 may be arranged to permanently provide buoyancy to the module while another part of the buoyancy system 117 may displace a volume to adjust the buoyancy from negative to positive. The permanent buoyancy of the buoyancy system 117 can be provided by a sealed off compartment of a displacement tank 130 filled with gas or a suitable low-density material, such as syntactic foam. The minimum buoyancy will depend on the drag of the module 100 as it descends. Similarly, the maximum buoyancy obtainable should be selected to enable the module 100 to ascend with a reasonably high speed to allow expedient operations, but not faster than safe navigation of the module 100 mandates.

FIG. 4 shows a buoyancy system 117 comprising a displacement tank 130 which may be filled with seawater or with a gas, such as air. To increase the buoyancy of the module 100, gas is introduced into the tank 130, displacing seawater. To lower the buoyancy, gas is let out of the tank 130 by a control means 131, thus letting seawater in. The control means 131 for controlling the filling of the tank with seawater may simply be one or more remotely operated valves letting gas in the tank 130 escape. The tank may have an open bottom, or it may completely encapsulate the contents. In case of an open tank, water will automatically fill up the tank 130 when the gas escapes, and in case of a closed tank, an inlet valve is needed to allow water to enter the tank 130.

FIG. 5 shows a buoyancy system 117 comprising a number of inflatable means 140 which may be inflated by expansion means 132. Any number of inflatable means 140 may be envisioned, e.g. one, two, three, four, five or more. The inflatable means 140 may be formed as balloons, airtight bags or the like, and may be inflated to increase buoyancy, e.g. when the intervention module 100 is to ascend to the sea surface after the intervention procedure. The expansion means 132 may comprise compressed gas, such as air, helium, nitrogen, argon, etc. Alternatively, the gas needed for inflation of the inflatable means 140 is generated by a chemical reaction, similarly to the systems used for inflation of airbags in cars. The inflatable means 140 must be fabricated from materials sufficiently strong to withstand the water pressure found at the desired operational depth. Such materials could be a polymer material reinforced with aramid or carbon fibres, metal or any other suitable reinforcement material. A buoyancy system 117 as shown in FIG. 5 may optionally comprise means for partly or fully releasing gas from an inflatable means 440 or even for releasing the whole inflatable means 140 itself.

In one embodiment, the intervention module 100, 160 has a longitudinal axis parallel to a longitudinal extension of the well 101, and the module is weight symmetric around its longitudinal axis. Such symmetric weight distribution ensures that the intervention module 100 does not wrench the well head 120 and the related well head structure when docked onto the well head.

In another embodiment, the buoyancy system 117 is adapted to ensure that the centre of buoyancy onto which the buoyant force acts is located on the same longitudinal axis as the centre of mass of the intervention module 100, and that the centre of buoyancy is located above the centre of mass. This embodiment ensures a directional stability of the intervention module 100.

As shown in FIG. 2, the intervention module 100, 160 comprises a power system 119 which is positioned on the module. The power system 119 can be in the form of a cable 106 connected to the surface vessel 102 or in the form of a battery, a fuel cell, a diesel current generator, an alternator, a producer or the like local power supplying means. In one embodiment, the power system 119 powers the well manipulation assembly 125 and/or other means of the module using hydraulic, pressurised gas, electricity or the like energy. By providing a local power supplying means or a reserve power to the intervention module 100, the intervention module is able to release itself from the well head 120 or another module and, if needed, bring up a tool in the well 101. This, at least, enables the intervention module 100 to self-surface, should such damage or other emergencies occur. In another embodiment, the local power supplying means allows the intervention module 100 to independently perform parts of the intervention procedure without an external power supply.

In some embodiments, the power system 119 comprises a power storage system for storage of energy generated. The power storage system may comprise a mechanical storage means being any kind of a tension system, pneumatic storage means, hydraulic storage means or any other suitable mechanical storage means.

Furthermore, the power system 119 of the intervention module 100 may be powered by at least one cable 106 for supplying power from above surface to the intervention module. The cable 106 is detachably connected to the intervention module 100 in a connection 108 enabling easy separation of the cable from the intervention module in the event that the surface vessel 102 needs to move. This is shown in FIG. 6 where the cable 106 has just been detached. The cable 106 may be adapted to supply the intervention module 100 with electrical power from the surface vessel 102 and may e.g. be provided as an umbilical or a tether.

Figure 8:
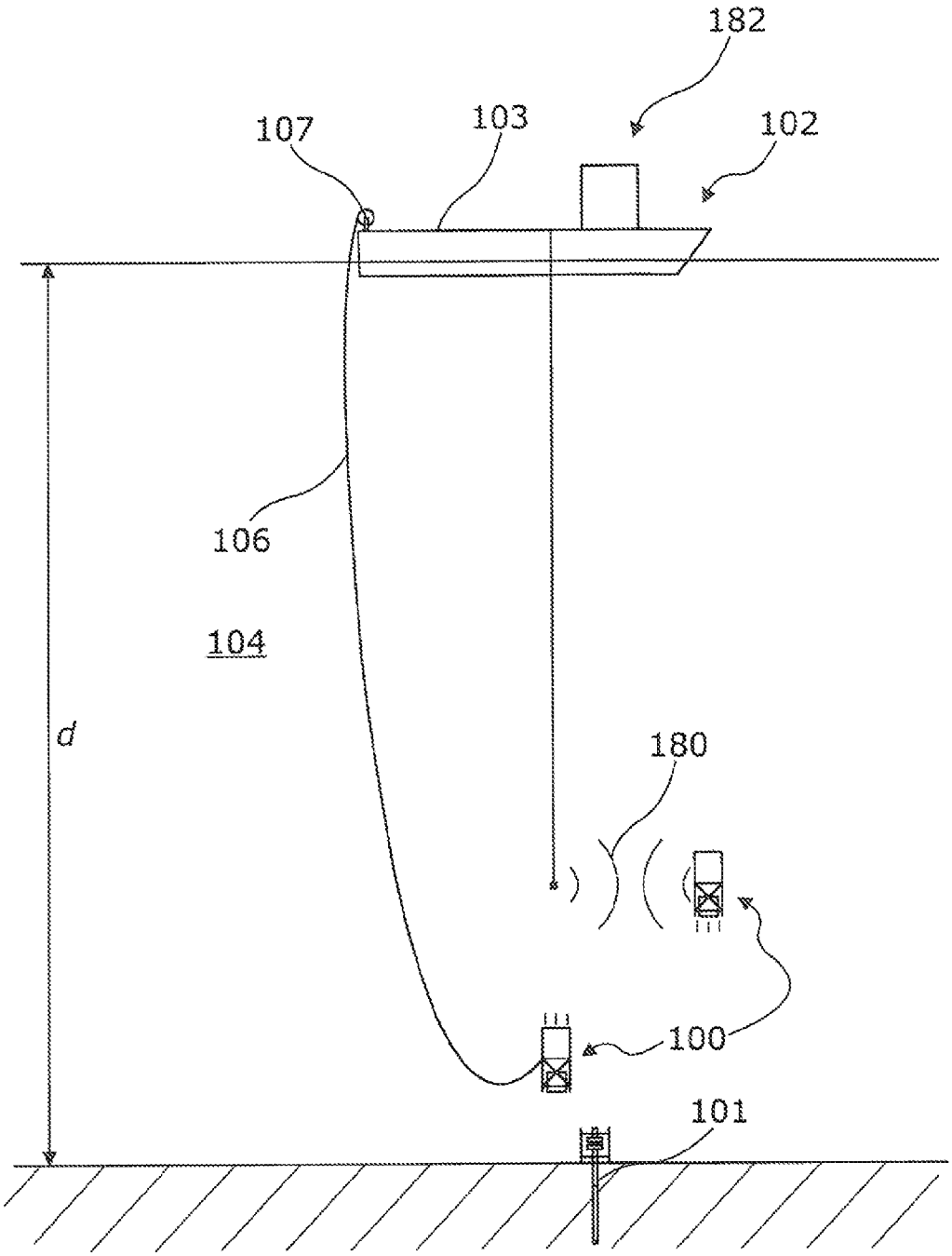
FIG. 8 shows one embodiment of a subsea well intervention system.
Figure 9:
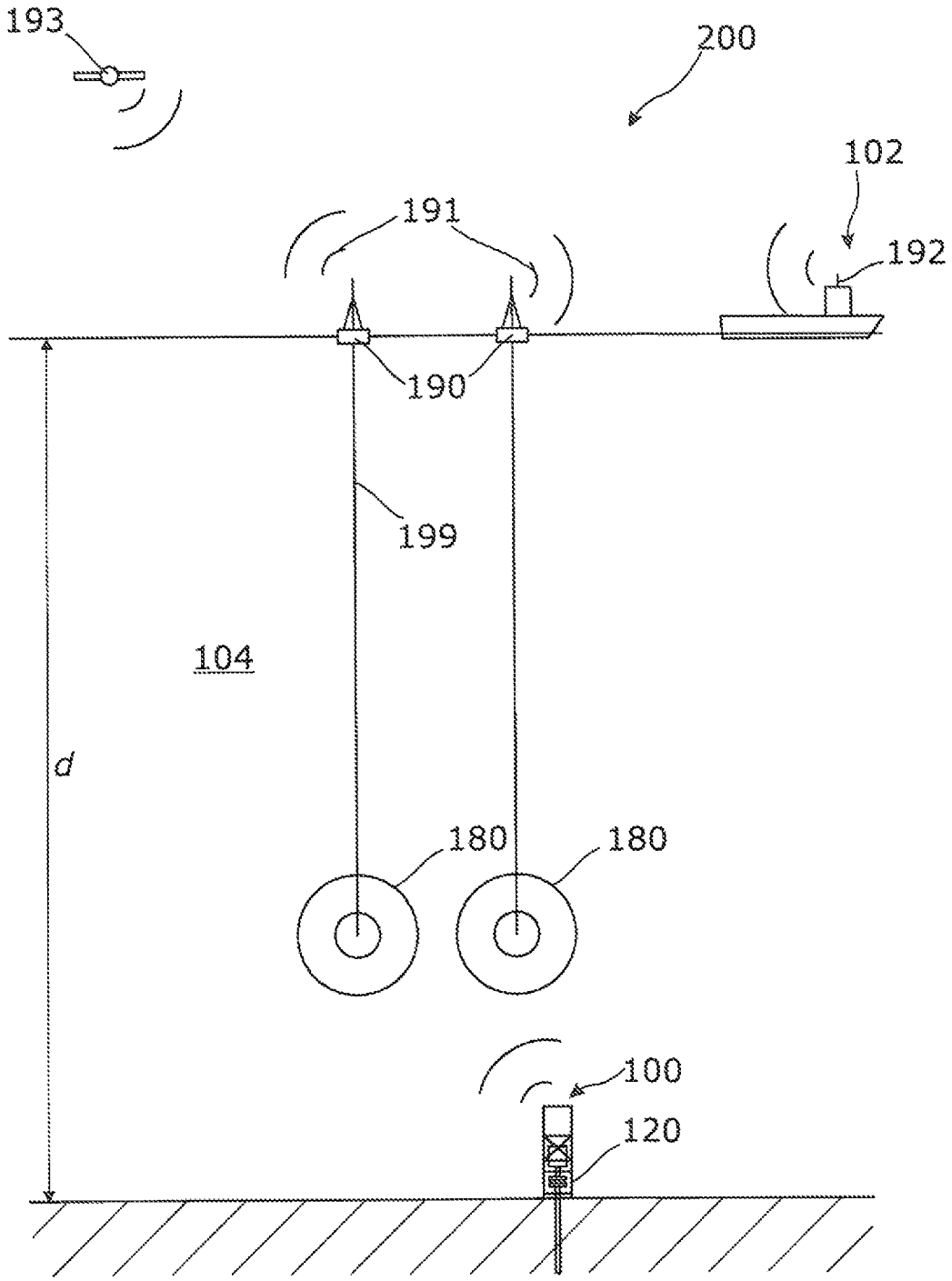
FIG. 9 shows another embodiment of the intervention system.

Communication with the surface vessel 102 enables the intervention module 100 to be remotely operated and to transmit various measurement and status data back to the vessel. The intervention module 100 may communicate by wire or wirelessly with the surface vessel 102 or with other units, submerged or on the surface. The communication wire may be a dedicated communication line provided as a separate cable or as a separate line within a power cable, or a power delivery wire connection, such as a power cable. In another embodiment, as shown in FIGS. 8 and 9, the intervention module 100 comprises wireless communicational means, such as radio frequency communication, acoustic data transmission, an optical link or any other suitable means of wireless underwater communication. Communication may take place directly with the intended recipient or by proxy, i.e. intermediate sender and receiver units, such as relay devices 190. The communication means may enable bi- or unidirectional communication communicating such data from the intervention module 100 as a video feed during the docking procedure, position, current depth reading, status of subsystems or other measurement data, e.g. from within the well 101. Communication to the intervention module 100 could e.g. be requests for return data, manoeuvring operations, control data for the well manipulation assembly, i.e. controlling the actual intervention process itself, etc.

In one embodiment, the control system 126 comprises both wired and wireless communicational means, e.g. so that a high-bandwidth demanding video feed may be transmitted by wire until the intervention module 100 is docked on the well head 120. When the module has been docked, less bandwidth-demanding communications, such as communication needed during the intervention itself, may be performed wirelessly by means of relay devices 190.

If the communication wire, e.g. combined with a power cable, is released from the intervention module 100, no physical connection is required between any surface or submerged vessel and the intervention module due to the fact that the intervention module may still be controlled by the wireless connection 180, 191. Thus, in one embodiment, the control system 126 comprises disconnection means 108, for disconnection of the cable for providing power to the system, a wireline for connection of the intervention module 100 to a vessel 102, or the attachment means 111. Subsequent to the disconnection, the intervention module 100 continues to function from its own power supply. When the cable has been released from the intervention module 100 and recovered on the surface vessel 102, the vessel is free to navigate out of position, e.g. to avoid danger from floating obstacles, such as icebergs, ships, etc.

To connect the well manipulation assembly 125 to the well head 120, the assembly further comprises at least one well head connection means 173 and a well head valve control means 174 for operating at least a first well head valve 121 for providing access of the tool into the well 101 through the well head connection means 173. Well heads typically have either mechanically or hydraulically operated valves. Thus, the well head valve control means 174, controlled by the intervention module control system 126, comprises means for operating the valve controls, such as a mechanical arm or a hydraulic connection, and a system for delivering the required mechanical or hydraulic force to the valve controls.

In the event that part of the well 101 is not substantially vertical, a downhole tractor can be used as a driving unit to drive the tool all the way into position in the well. A downhole tractor is any kind of driving tool capable of pushing or pulling tools in a well downhole, such as a Well Tractor®.

The supporting structure 110 is a frame structure having a height, a length and a width corresponding to the dimensions of a standard shipping container. A shipping container may have different dimensions, such as 8-foot (2.438 m) cube (2.44 m×2.44 m×2.44 m) units used by the United States' military, or later standardised containers having a longer length, e.g. 10-foot (3.05 m), 20-foot (6.10 m), 40-foot (12.19 m), 48-foot (14.63 m) and 53-foot (16.15 m) lengths. European and Australian containers may be slightly wider, such as 2 inches (50.8 mm).

In a further embodiment, the power system 119 has an amount of reserve power large enough for the control system 126 to disconnect the well head connection means 173 from the well head 120, the cable for providing power from the power system 119, the wireline from the module, and/or the attachment means 111 from the well head structure. In this way, the intervention module 100 can resurface even if a cable needs to be disconnected, e.g. due to an oncoming risk to the surface vessel 102. In one embodiment, the required reserve power may be provided by equipping the intervention module 100 with a suitable number of batteries enabling the required operations.

A typical intervention operation requires at least one additional configuration of the well manipulation assembly 125, besides the configuration with a tool. As mentioned, the additional configuration can be a cap removal assembly 151 or a first and second crone plug pulling tool. Such cap removal means 134 may be adapted to pull or unscrew the protective cap 123 of the well 101, depending on the design of the well head 120 and/or the protective cap 123. Furthermore, the cap removal means 134 may be adapted to vibrate the cap 123 to loosen debris and sediments which may have been deposited on the cap. The first crone plug pulling tool is an intervention tool connected with a connector for connecting to the crone plug, and the intervention tool pulls the first plug which is kept in the connection member. The second module is then docked onto the well head and the second plug is pulled with a similar or the same intervention tool. By using several intervention tools, the second module can wait in the vicinity of the well head until the first run is finished and the first module is disconnected.

As shown in FIG. 9, some embodiments of the subsea well intervention system 100 comprise at least one autonomous communication relay device 190 for wirelessly receiving waterborne signals 180 from the intervention module 100, 160, converting the signals from the module 100 into airborne signals 191 and transmitting the airborne signals to the remote control means 192, and vice versa, to receive and convert signals from the remote control means and transmit the converted signals to the intervention module 100.

In an embodiment, the autonomous communication relay device 190 is designed as a buoy and has a resilient communication cable 194, 199 hanging underneath. The communication relay device 190 may be a small vessel, a dinghy, a buoy or any other suitable floating structure. Preferably, the relay device 190 comprises navigation means 105 enabling it to be remotely controlled from the surface vessel 102, e.g. to maintain a specific position. Also, in some embodiments, the relay device 190 comprises means for detecting its current position, such as a receiver 193 for the Global Positioning System (GPS).

In FIG. 8, the resilient communication cable 194, 199 hangs underneath the vessel 102 where the end of the cable has means for communicating with a first 100 and a second 100, 160 module.

Airborne communication to and from the intervention module 100 is relayed between underwater communicational means and above-surface communicational means, such as antennas 192, as seen in FIG. 9. Underwater communication means may be a wire which is connected to the intervention module 100 (see FIG. 10), or it may be a means for wireless underwater communication, e.g. by use of radio frequency signals or optical or acoustic signals. If wireless communication is used, the communicational relay device 190 may be adapted for lowering the underwater communicational means far down into the water, e.g. to reach depths of 10-100%, alternatively 25-75%, or even 40-60% of the water depth. This limits the required underwater wireless transmission distance as it may be required to circumvent the excessively large transmission losses of electromagnetic radiation in sea water. Airborne communication may take place with the surface vessel 102 or with e.g. a remote operations centre.

Figure 10:
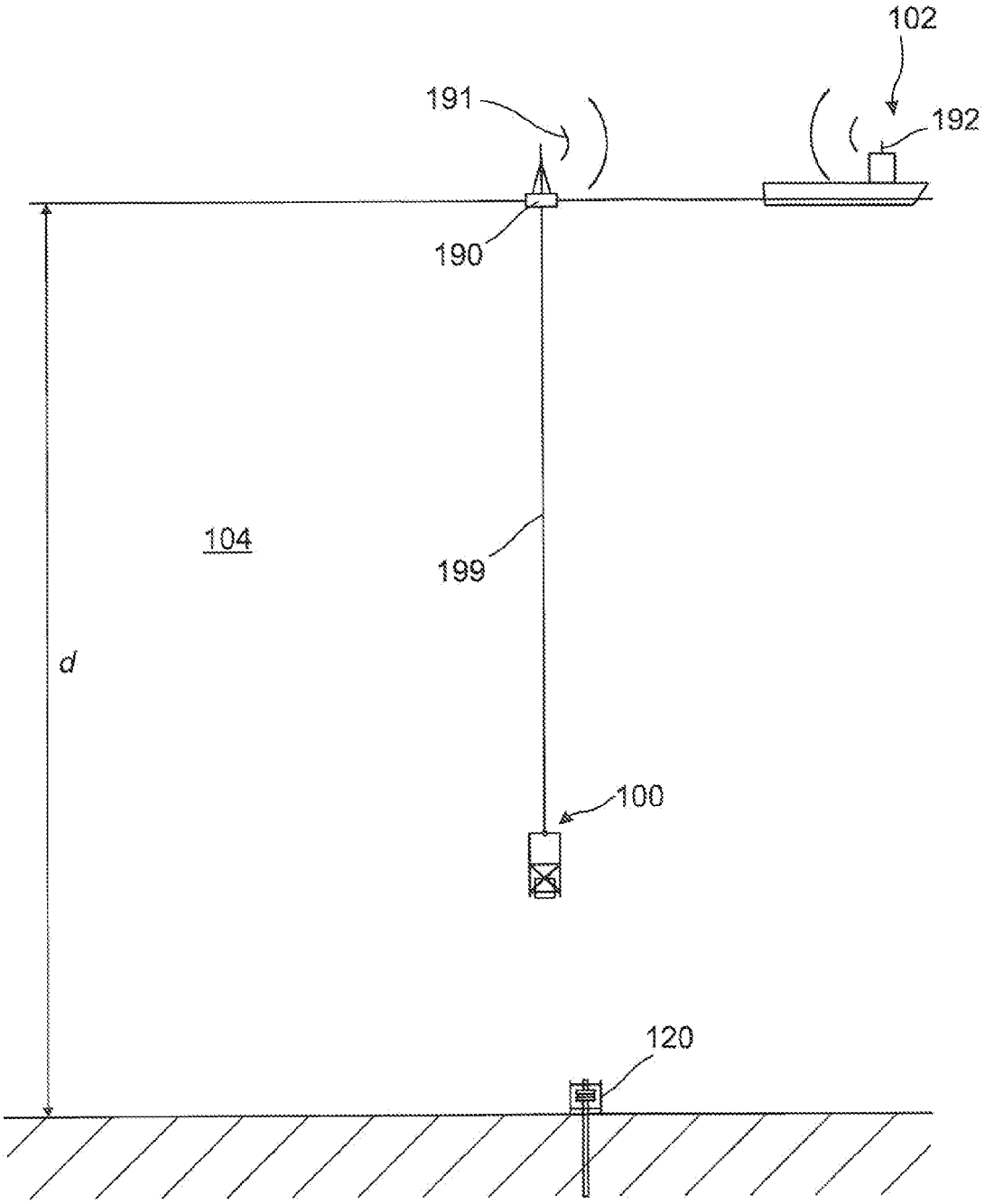
FIG. 10 shows yet another embodiment of the intervention system.

FIG. 10 shows an embodiment where the underwater communication means of the relay device 190 is a communication wire 199 which is connected to the intervention module 100, and which may be pulled out from the relay device 190 as the intervention module descends. The relay device 190 may be provided with means for spooling out the wire 199, or the wire may simply be pulled from a spool by the weight of the intervention module 100 as the module descends. The wire 199 may be hoisted either by electro-mechanical means, such as a winch, or by purely mechanical means, such as a tension system.

A subsea well intervention utilising intervention modules according to the present intervention thus comprises the steps of positioning a surface vessel 102 in vicinity of the subsea well head 120, connecting a subsea well intervention module 100 to a wireline on the vessel, dumping the subsea well intervention module 100 into the sea from the surface vessel 102 by pushing the module over an edge of the vessel, controlling the navigation means 105 on the intervention module 100, manoeuvring the module 100 onto the well head 120, connecting the module 100 onto the well head 120, controlling the control system 126 to perform one or more intervention operations, detaching the module 100 from the well head 120 after performing the operations, and recovering the module 100 onto the surface vessel 102 by pulling the wireline. The surface vessel 102 does not need to be accurately positioned over the well head 120 since the module 100 navigates independently and is not suspended from the vessel. Furthermore, the often critical prior art procedure of deploying the intervention module into the water is significantly simplified since the module 100 may merely be pushed over the side 103 of the surface vessel 102. This enables deployment of an intervention module 100 in rough conditions which would otherwise be prohibitive for intervention operations. Also, since the module 100 is remotely operated, there is no need for deploying additional vehicles, such as ROVs, thus further simplifying the intervention operation.

In some embodiments of the intervention method according to the invention, one or more additional subsea well intervention modules are dumped sequentially after or simultaneously with the first module. As the first intervention module performs its designated operations, the next intervention module may be prepared on the surface vessel 102 and launched into the sea to descend towards the well head 120. When the first intervention module has performed its operations, it may return to the surface by its own means while the second intervention module waits in the proximity of the well head 120 to be docked on the well head. By having an awaiting second intervention module, a quick change from one intervention module to the next is possible, compared to a situation where multiple intervention modules need to be lowered by crane onto the well head, e.g. via a set of guide wires. In that case, more time is needed to perform the intervention.

The invention claimed is:

1. A mobile subsea well intervention module for performing well intervention operations in a well through a well head from a surface vessel, comprising:

a supporting structure, a pipe assembly fastened to the supporting structure, the pipe assembly having a first end and a second end, an inner diameter, and a cavity which is configured to be pressurized to wellbore pressure when connected to the well head or a blowout preventer arranged on top of the well head before at least one valve of the well head is opened, an intervention tool arranged in the cavity and configured to be submerged in the well after the at least one valve of the well head is opened; and a connection member connected with the first end of the pipe assembly and configured to detachably connect to the well head;

wherein the intervention tool includes a wireless intervention tool having an outer diameter and comprising an electrical power device; and the connection member has an open first end open to a subsea environment while submerged until detachably connected with the well head or blowout preventer and a through-bore providing fluid passage from the first end of the connection member to the cavity; and the second end of the pipe assembly is configured to be closed to the subsea environment while submerged.

2. The mobile subsea well intervention module according to claim 1, wherein the outer diameter of the wireless intervention tool is at least 50% of the inner diameter of the pipe assembly.

3. The mobile subsea well intervention module according to claim 1, wherein the inner diameter of the pipe assembly is less than an inner diameter of the connection member.

4. The mobile subsea well intervention module according to claim 1, wherein the pipe assembly has a wall thickness being less than a wall thickness of the connection member.

5. The mobile subsea well intervention module according to claim 1, wherein the pipe assembly has a coupling comprising:

a first end for engaging with the intervention tool in order to recharge; or a first end for engaging with the intervention tool in order to communicate data to and from the intervention tool; or a first end for engaging with the intervention tool in order to communicate instructions to and from the intervention tool or a first end for engaging with the intervention tool in order to recharge and for engaging with the intervention tool in order to communicated data to and from the intervention tool; or a first end for engaging with the intervention tool in order to recharge and a first end for engaging with the intervention tool in order to communicate instructions to and from the intervention tool; or a first end for engaging with the intervention tool in order to communicate data and instructions to and from the invention tool; or a first end for engaging with the intervention tool in order to recharge and for engaging with the intervention tool in order to communicate data and instructions to and from the invention tool; and a second end for providing a connection to an electrical source; or a second end for providing a connection to a communication device; or a second end for providing a connection to an electrical source and a communication device.

6. The mobile subsea well intervention module according to claim 1, wherein the coupling comprises:

a docking station for engaging with the intervention tool in order to recharge; or a docking station for engaging with the intervention tool in order to communicate data to and from the intervention tool; or a docking station for engaging with the intervention tool in order to communicate instructions to and from the intervention tool; or a docking station for engaging with the intervention tool in order to recharge and in order to communicate data to and from the intervention tool; or a docking station for engaging with the intervention tool in order to recharge and in order to communicate instructions to and from the intervention tool; or a docking station for engaging with the intervention tool in order to communicate data and instructions to and from the intervention tool; or a docking station for engaging with the intervention tool in order to recharge and in order to communicate data and instructions to and from the intervention tool.

7. The mobile subsea well intervention module according to claim 6, wherein the docking station comprises a wet connector for engagement with a corresponding connector in the intervention tool.

8. The mobile subsea well intervention module according to claim 6, wherein the docking station is arranged at a second end of the pipe assembly.

9. The mobile subsea well intervention module according to claim 6, further comprising a communication device, and wherein the docking station of the pipe assembly is connected with the communication device.

10. The mobile subsea well intervention module according to claim 5, wherein the coupling is an inductive coupling having a first coil device facing an inside of the pipe assembly and a second coil device facing an outside of the pipe assembly.

11. The mobile subsea well intervention module according to claim 10, wherein the first coil device is arranged in one end of the intervention tool.

12. The mobile subsea well intervention module according to claim 10, wherein the second coil device is connected to a wireline.

13. The mobile subsea well intervention module according to claim 1, wherein the supporting structure is a frame structure having an outer form and defining an internal space containing a well manipulation assembly and a navigation means having propulsion means enabling the intervention module to move freely in the water, the well manipulation assembly and the navigation means both extending within the outer form.

14. The mobile subsea well intervention system comprising a well head or blowout preventer, and at least one subsea intervention module according to claim 1, wherein the connection member of the subsea intervention module is connected directly to the well head or the blowout preventer; or a well head and blowout preventer, and at least one subsea intervention module according to claim 1, wherein the connection member of the subsea intervention module is connected directly to the well head or the blowout preventer.

15. The mobile subsea well intervention system according to claim 14, further comprising at least one remotely operational vehicle for navigating the intervention module onto the well head or another module subsea.

16. The mobile subsea well intervention system according to claim 14, further comprising at least one remote control means having a control system and for remotely controlling some or all functionalities of the intervention module, the remote control means being positioned above water.

17. The mobile subsea well intervention method for performing an intervention operation by means of the intervention module according to claim 1, comprising the steps of:

positioning a surface vessel or rig in the vicinity of the subsea well head, connecting a subsea well intervention module to the wireline on the vessel, entering the subsea well intervention module into the water, maneuvering the module onto the well head or blow out preventer, connecting the module to the well head, submitting the tool inside the pipe assembly to the wellbore pressure, opening the valve, and entering the well by means of the intervention tool for performing an operation, recharging a battery in the pipe assembly, and wherein the step of connecting the module to the well head or blowout preventer is connection of the connection member of the module directly to the well head or the blowout preventer.

18. The mobile subsea well intervention method according to claim 17, further comprising the steps of:

charging the battery in the pipe assembly; or sending information through the coupling; or receiving information through the coupling; or charging the battery in the pipe assembly and sending information through the coupling; or charging the battery in the pipe assembly and receiving information through the coupling; or sending and receiving information through the coupling; or charging the battery in the pipe assembly and sending and receiving information through the coupling.

19. The mobile subsea well intervention module according to claim 1, wherein the outer diameter of the wireless intervention tool is at least 75% of the inner diameter of the pipe assembly.

20. The mobile subsea well intervention module according to claim 1, wherein the outer diameter of the wireless intervention tool is at least 90% of the inner diameter of the pipe assembly.

21. The mobile subsea well intervention module according to claim 1, wherein the second end of the pipe assembly is configured to be sealed to the outside environment during use.

22. The mobile subsea well intervention module according to claim 1, wherein the pipe assembly and the intervention tool are configured to approach and enter the well without requiring grease to seal the second end.

23. The mobile subsea well intervention module according to claim 1, wherein the intervention tool is configured to be operated without wires providing control instructions.

24. The mobile subsea well intervention module according to claim 1, wherein the intervention tool is configured to be operated without wires providing power.

25. The mobile subsea well intervention module according to claim 1, wherein the second end of the pipe assembly is configured to have no wires passing therethrough during operation.

* * * * *